US010883280B2

(12) United States Patent
Decruy et al.

(10) Patent No.: US 10,883,280 B2
(45) Date of Patent: Jan. 5, 2021

(54) SKIRTING BOARD AND AN IMPROVED METHOD FOR MANUFACTURING A SKIRTING BOARD OR FINISHING PROFILED SECTION

(71) Applicant: Decruy NV, Houthulst (BE)

(72) Inventors: Frederik Decruy, Houthulst (BE); André Decruy, Merkem (BE)

(73) Assignee: Decruy NV, Houthulst (BE)

( * ) Notice: Subject to any disclaimer, the term of this patent is extended or adjusted under 35 U.S.C. 154(b) by 0 days.

(21) Appl. No.: 16/072,248

(22) PCT Filed: Jan. 25, 2017

(86) PCT No.: PCT/IB2017/050389
§ 371 (c)(1),
(2) Date: Jul. 24, 2018

(87) PCT Pub. No.: WO2017/130114
PCT Pub. Date: Aug. 3, 2017

(65) Prior Publication Data

US 2019/0032343 A1 Jan. 31, 2019

(30) Foreign Application Priority Data

Jan. 25, 2016 (BE) ..... 2016/5063
Feb. 4, 2016 (BE) ..... 2016/5088

(51) Int. Cl.
*E04B 2/00* (2006.01)
*E04F 19/06* (2006.01)
*E04F 19/04* (2006.01)

(52) U.S. Cl.
CPC ..... *E04F 19/061* (2013.01); *E04F 19/04* (2013.01); *E04F 19/062* (2013.01); (Continued)

(58) Field of Classification Search
None
See application file for complete search history.

(56) References Cited

U.S. PATENT DOCUMENTS 2,926,401 A * 3/1960 Place ..... E06B 7/2314 49/468
3,436,297 A * 4/1969 Brooks ..... B29C 70/08 428/164

(Continued)

FOREIGN PATENT DOCUMENTS

BE 1018494 A3 2/2011
BE 1019285 A3 5/2012

*Primary Examiner* — Basil S Katcheves
(74) *Attorney, Agent, or Firm* — James Creighton Way

(57) ABSTRACT

The present invention relates, on the one hand, to a skirting board for a wall of a space or finishing profiled section for floor covering, comprising a body composed of at least a carrier material and a decorative top layer, in which said body comprises a longitudinal part which forms at least a part of the front side of the skirting board or the finishing profiled section, and a top part which forms at least a part of the top side of the skirting board or the finishing profiled section, in which the transition (1 1) between the longitudinal part and the top part has a curved configuration, in which, at the location of said transition, some of the carrier material has been replaced by a filler having a different composition than the carrier material, and that the decorative top layer (2) is continuous at the location of the transition (1 1). On the other hand, the present invention relates to a method for manufacturing such a skirting board.

20 Claims, 25 Drawing Sheets

Figure 1:
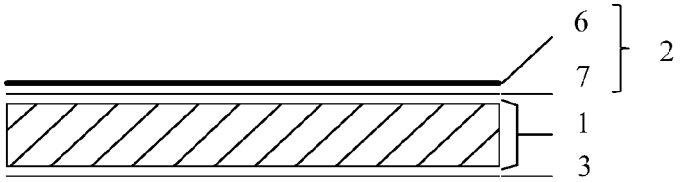

(52) U.S. Cl.
CPC ..... *E04F 19/064* (2013.01); *E04F 19/065* (2013.01); *E04F 19/068* (2013.01); *E04F 2019/0454* (2013.01)

(56) References Cited

U.S. PATENT DOCUMENTS 4,504,347 A * 3/1985 Munk ..... B27N 5/00 156/245
6,134,854 A * 10/2000 Stanchfield ..... E04F 11/16 52/480
6,230,385 B1 * 5/2001 Nelson ..... E04F 19/062 29/450
8,109,059 B2 * 2/2012 Proot ..... E04F 19/061 52/312
8,327,595 B2 * 12/2012 Stanchfield ..... E04F 15/02005 52/100
8,484,919 B2 * 7/2013 Brunedal ..... E04F 11/16 52/311.1
8,528,285 B2 * 9/2013 Kornfalt ..... E04F 19/062 52/395
2006/0150565 A1 * 7/2006 Schacht ..... E04F 15/02005 52/716.1
2006/0201093 A1 * 9/2006 Stanchfield ..... E04D 1/365 52/459
2007/0125021 A1 * 6/2007 Thiers ..... B27D 5/003 52/288.1
2007/0182203 A1 * 8/2007 Kellinghaus ..... E04F 19/061 296/146.9
2007/0283654 A1 * 12/2007 Stanchfield ..... B23D 45/003 52/465
2008/0034696 A1 * 2/2008 Neuhofer ..... E04F 19/061 52/466
2008/0034700 A1 * 2/2008 Stanchfield ..... E04F 19/061 52/582.1

* cited by examiner

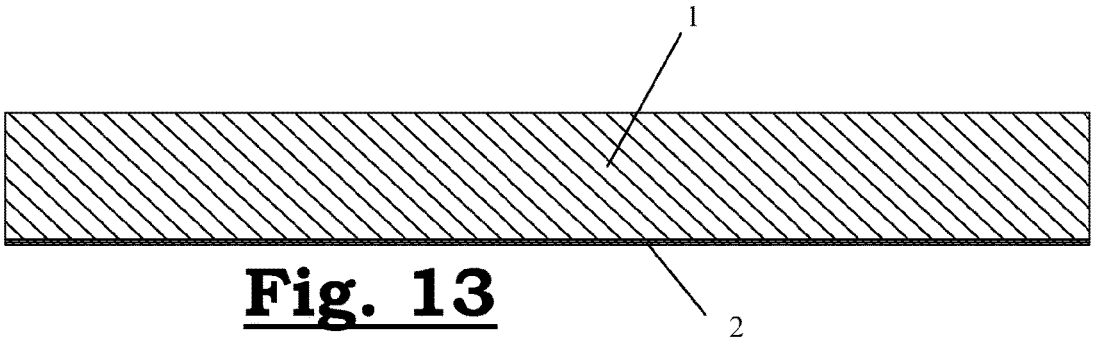
Fig. 13
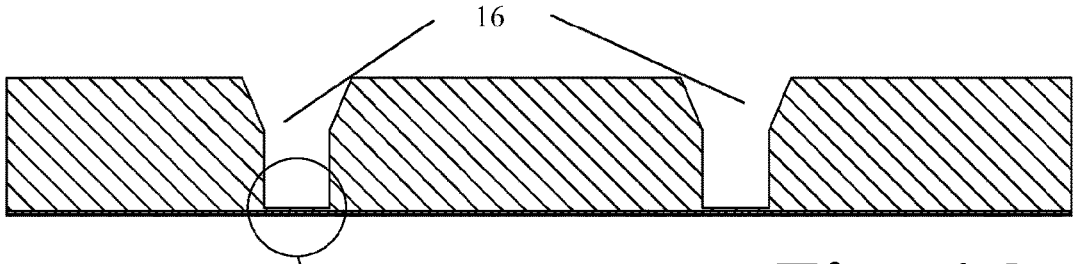
Fig. 14
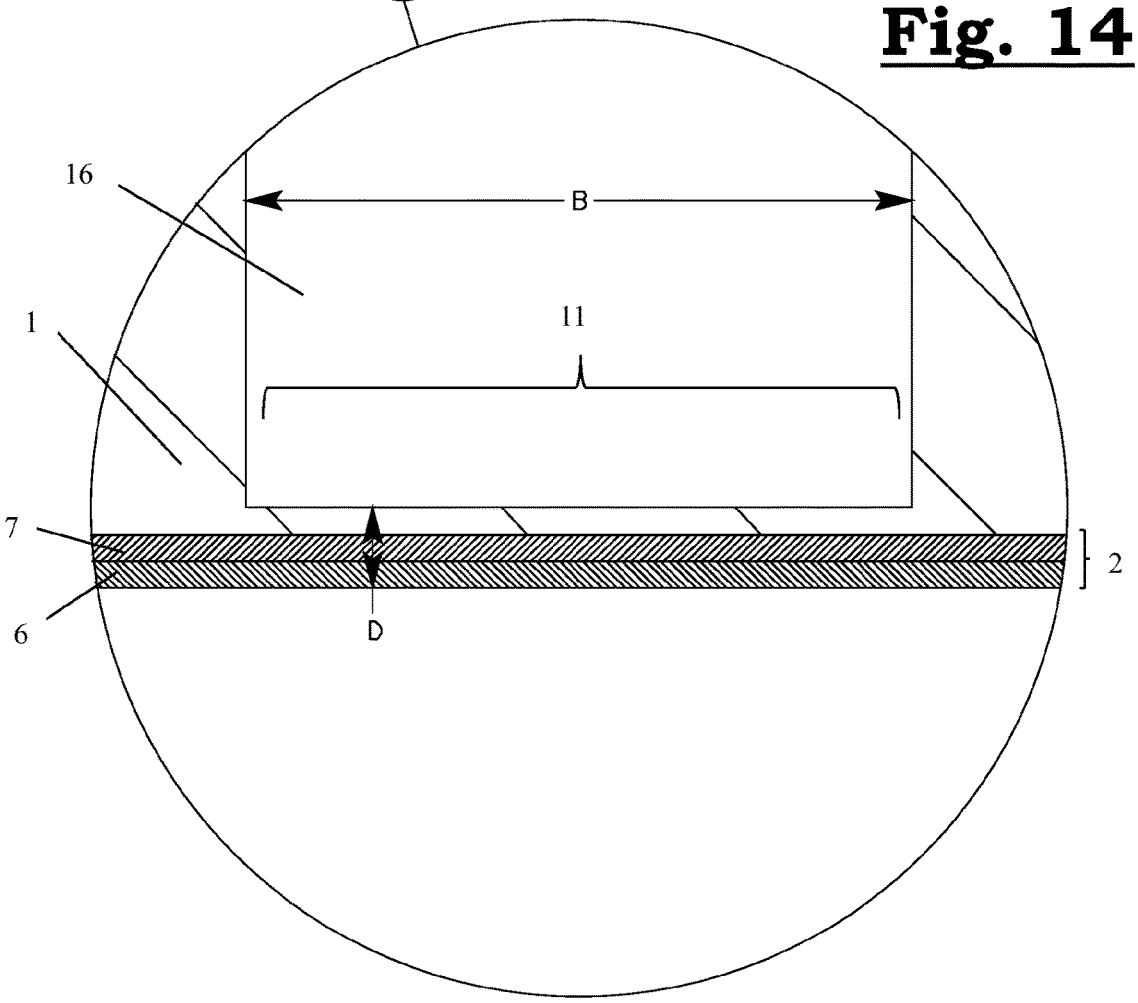

Fig. 27
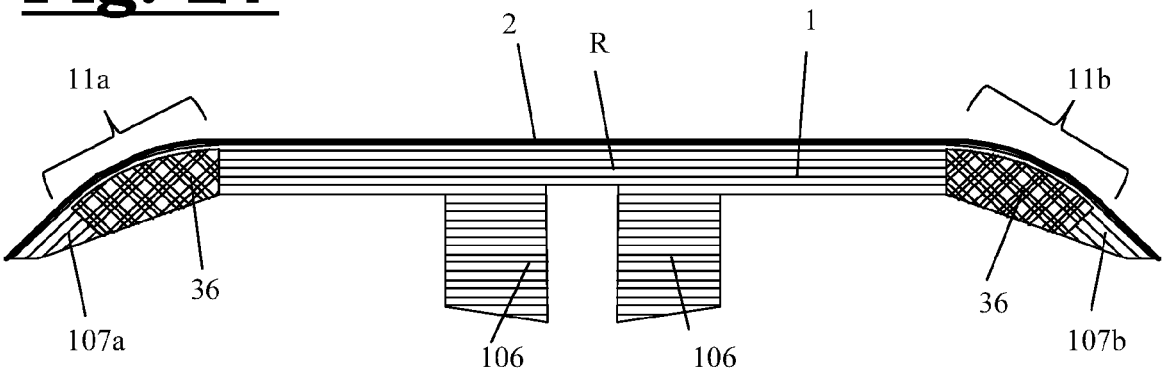
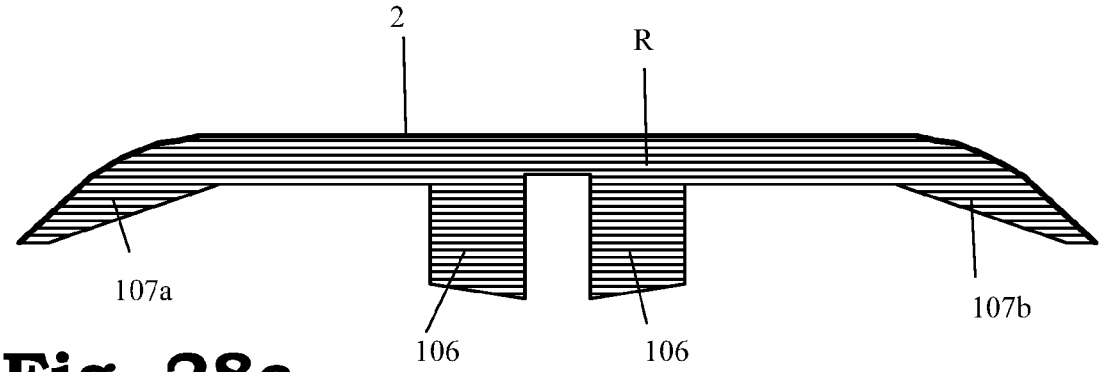
Fig. 28a
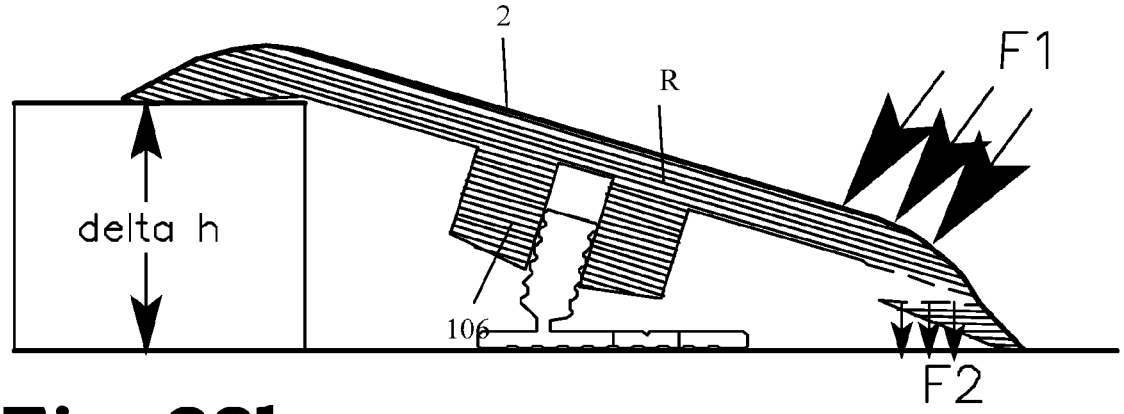
Fig. 28b

Fig. 29c
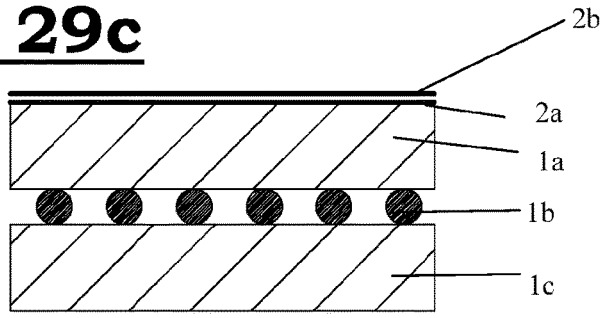
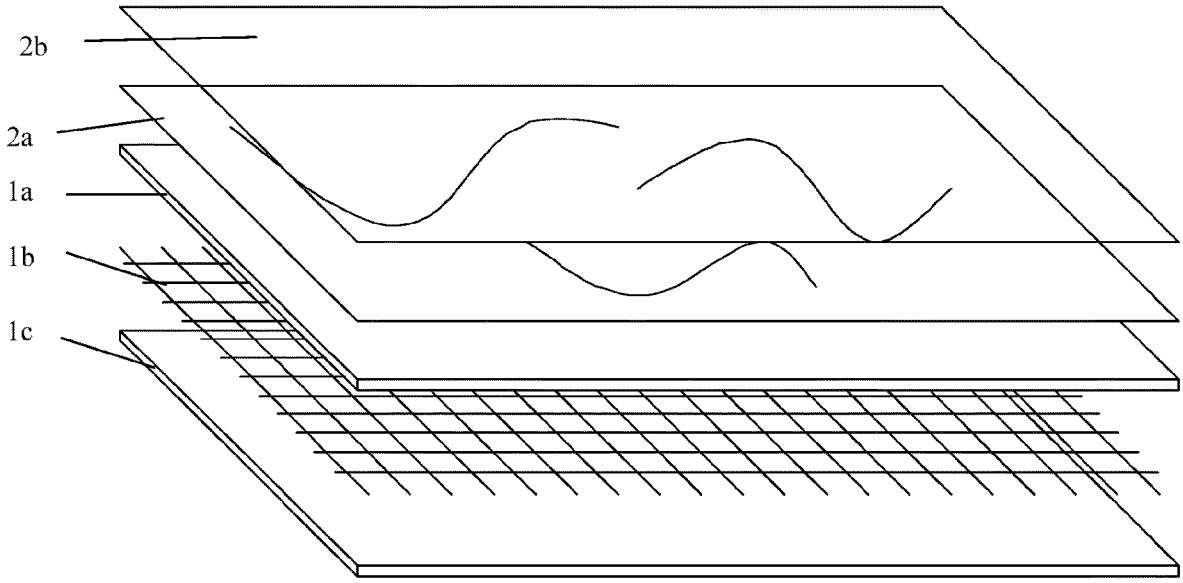
Fig. 29d

Fig. 36
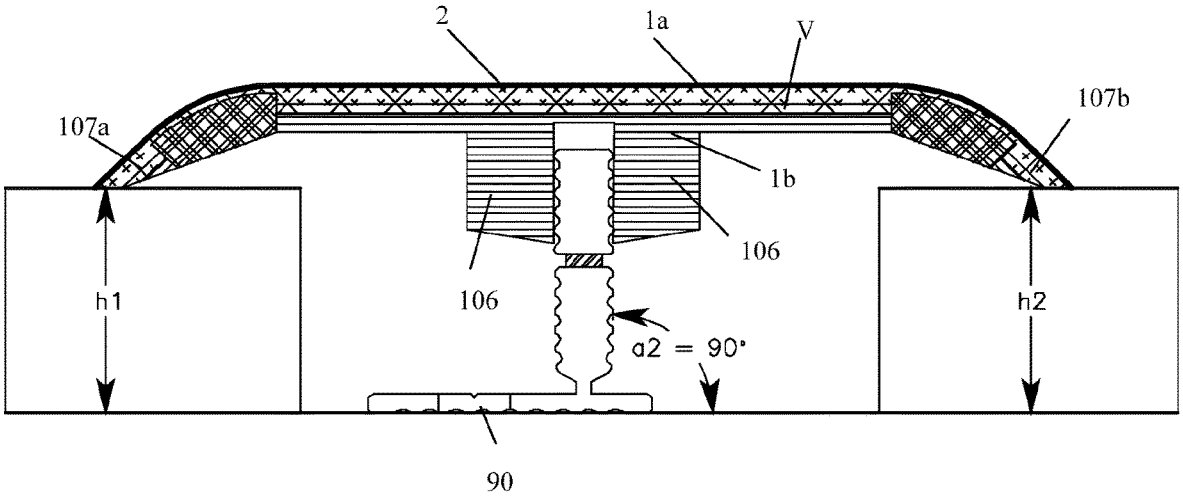
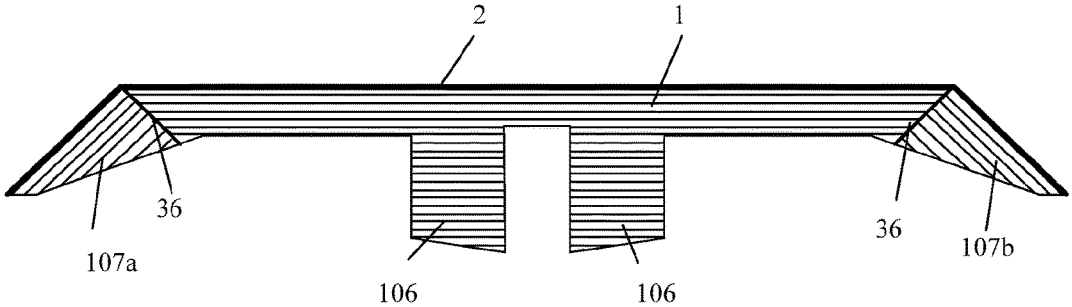
Fig. 37

SKIRTING BOARD AND AN IMPROVED METHOD FOR MANUFACTURING A SKIRTING BOARD OR FINISHING PROFILED SECTION

This application claims the benefit of Belgian Application No. BE-2016/5063 filed Jan. 25, 2016, Belgian Application No. BE-2016/5088 filed Feb. 4, 2016 and PCT/IB2017/050389 filed Jan. 25, 2017, International Publication No. WO 2017/130114 A1, which are hereby incorporated by reference in their entirety as if fully set forth herein. The present invention relates to a skirting board for floor covering and an improved method for producing such a skirting board or a finishing profiled section.

The present invention relates to a skirting board for floor covering and the method for producing a skirting board or finishing profiled section made of a sheet material. This sheet material serves as floor covering and may be different in nature. Examples of such sheet materials are, inter alia, DPL (Direct Pressed Laminate), HPL (High Pressure Laminate), CPL (Continuous Pressed Laminate), LVT (Luxury Vinyl Tiles), cushion vinyl, WPC (Wood Plastic Composite), DLP (Direct Laminate Printing) or may be a combination of these abovementioned sheet materials.

A DPL panel is composed of a bottom layer made of plastic, usually melamine, a support material, generally High-Density Fibreboard (HDF) on which a layer of printed paper (usually imprinted with an imitation wood structure) is provided with a plastic top layer, usually melamine reinforced with corundum or aluminium oxide. With the relatively inexpensive products, the top or wear layer is thin, as a result of which the service life is relatively short.

The structure of a DLP panel is more or less similar to that of a DPL panel, except that the layer of printed paper is absent. Instead, the HDF support panel is printed on directly and subsequently finished with the top layer. The carrier material may also be a WPC (Wood Plastic Composite) panel or a different plastic panel.

There are many different other products which may be used in addition to the 2 abovementioned types. Thus, floor covering exists which is in the form of boards which are laid on a surface. These boards are usually connected to each other by means of a click-fit connection. Such boards are composed of a core made of MDF, HDF, PVC, PP or WPC (Wood Plastic Composite), etc. The top side of these boards is provided with a decorative top layer. This layer may comprise one or more decorative layers and be covered with a scratch-resistant top layer and may, depending on use, differ in terms of design, structure and scratch resistance. The decorative top layer may thus be made from a laminate in the form of DPL (Direct Pressed Laminate), CPL (Continued Pressed Laminate) or HPL (High Pressed Laminate), DLP (a digitally printed layer). Decorative layers made of PVC, PP layer or scratch-resistant paper are possible and form part of the prior art.

There are various different skirting boards or profiled sections available to finish these floor coverings. In many cases, these skirting boards or profiled sections are made by providing a supporting profiled section with a film/foil layer by means of the known process of wrapping. The carrier material of wrapped profiled sections often consists of MDF, HDF or PVC. The decorative film/foil layers are often PVC film or paper foil provided with a print which matches the respective floor covering. For profiled sections, such as transition profiled sections or adjustment profiled sections, a CPL film is often used due to its scratch resistance.

However, one problem is that such profiled sections or skirting boards never match the respective floor covering perfectly. The print or structure is practically never identical to the floor covering. In particular, the structure is quite important, since many structures are "embossed in register", which is to say that the structure is synchronous with the decoration. Until now, it has not been possible to provide such techniques or qualities of finish on films/foils, as a result of which the finish of the skirting board is always inferior to that of the floor.

A second problem associated with wrapping films/foils is durability. On account of sunlight or UV light, discolouration or ageing will occur. As long as the top layer of the skirting boards is not identical to the top layer of the floor panels, these will never age in the same way and a significant difference in colour may develop over time between the skirting boards and the floor covering, resulting in a less appealing finish.

A third problem of traditional wrapped profiled sections is that a film/foil stock has to be provided for each design or floor panel for manufacturing the above-described finishing strips or skirting boards. These films/foils often have to be bought in large numbers, as a result of which this is very costly for the producer of the floor. Thanks to digital printing, these volumes can be kept at a minimum, but even then the print or structure will never be identical to the respective floor panel. Often, digitally printed films/foils also do not have the required scratch resistance, as a result of which they cannot be used as finishing strips to be walked on.

The above-described problems could be solved if skirting boards or profiled sections could be made from the same sheet material from which the floor panel is made. After all, the floor panels are produced by sawing a large mother panel into smaller pieces. This mother panel could then be used to manufacture skirting boards or profiled sections from.

Techniques are already known in the prior art which enable a skirting board to be manufactured. Thus, the patent holder has previously developed a technique, which is described in BE 1019285, and which allows a skirting board to be manufactured by folding a panel-shaped material. To this end, recesses are provided on the rear side of the skirting board as far as the decorative top layer, following which the panel-shaped material is folded closed to form a skirting board. This folding is possible because the decorative layer is a film/foil based PVC or PP which is flexible and can therefore be folded over an angle of 90° without any problems.

A drawback of the technique described in BE 1019285 is that it is not suitable for skirting boards or finishing strips made of DPL or DLP sheet material. The reason for this is that the top layer is very thin (+/−0.3 mm), brittle and fragile, as a result of which the top layer will break or tear if even the smallest attempt of folding it or exerting pressure on it is made.

If we want to produce a skirting board which is as appealing or of the same quality as the traditional skirting boards or profiled sections, the decorative film/foil or top layer has to run continuously along the entire visible side of the skirting board. Another drawback of BE 1019285 is that the corners which are formed are always sharp, as a result of which it is less aesthetically pleasing or, in some cases, not functional.

It is therefore an object of the present invention to develop a skirting board which is produced from a floor panel, and furthermore to provide a method by means of which it is possible to manufacture such skirting boards or finishing profiled sections from floor panels (DPL, LVT, DLP, HPL, CPL panels) and in which the corners may be rounded or assume a well-defined shape.

The object of the invention is achieved by the skirting board as described in the first claim. Another subject of the present invention relates to a finishing profiled section for floor covering. This finishing profiled section for floor covering comprises a body composed of at least a carrier material and a decorative top layer, in which said body comprises a front side, which is the side comprising the top layer, and a rear side, in which the front side comprises at least one transition having a curved configuration in which the decorative top layer is continuous at the location of the transition and in which, at the location of said transition, the rear side, at least at the location of the transition, comprises a recess which is at least partly filled with a filler having a different composition than the carrier material.

A further subject of the present invention relates to a method for producing the skirting board or finishing profiled section. The method according to the present invention in particular relates to a method for producing a skirting board or finishing profiled section for floor covering, comprising a body composed of at least a carrier material and a decorative top layer, in which said body comprises a front side, being the side with the top layer, and a rear side, in which the front side comprises at least one transition having a curved configuration in which the decorative top layer is continuous at the location of the transition. The method according to the invention comprises the following steps:

- supplying a panel-shaped element comprising a carrier material on which a decorative top layer is provided;
- providing a recess on the rear side of the panel-shaped element in the longitudinal direction in the carrier material at the location of the transition, so that a residual part is formed comprising a residual layer of carrier material with a decorative top layer;
- filling said recess with a filler having a different composition than the carrier material;
- bending the residual part to the desired radius or shape;
- allowing the filler to harden.

In a particular embodiment of the method according to the invention, the filler may also be an adhesive, or a combination of an adhesive and a filler having a composition which differs from the carrier material.

The object of the invention can only be achieved if we find a possibility to bend the decorative top layer in such a way that the decorative top layer runs continuously along the entire visible side of the skirting board.

The technique described in BE 1019285 cannot be used with DPL, since the corner will break if it is folded to 90°. After all, the technique described in BE 1019285 describes a folding technique using a V groove. Since this V groove ends in a point, the top layer will break in the point during folding.

At the same time, it is a great challenge to produce such skirting boards in a quick and economically viable way compared to traditional skirting boards or finishing strips. A method will thus have to be devised in which these skirting boards or profiled sections can be manufactured. This is made possible by means of the method according to the invention.

The method allows a skirting board or profiled section to be manufactured from hard or flexible panels, in which part of the respective panel is bent without this causing tears (or cracks) in the decorative top layer. Also, this method and consequently the skirting board or profiled section formed will be sufficiently strong to be able to resist impact so that it is possible to walk on these profiled sections.

Preferred embodiments of the skirting boards or profiled sections and of the method according to the invention are described in the dependent claims.

In the following description, reference numerals are used to refer to the attached figures, in which:

FIG. 1: Structure of a floor panel containing a carrier material (1), a decorative layer (7), a scratch-resistant top layer (6) and a backing (3). The carrier material may consist of HDF, MDF, LDF, chipboard, PVC, PP, WPC (Wood Plastic Composite), etc.

Figure 2:
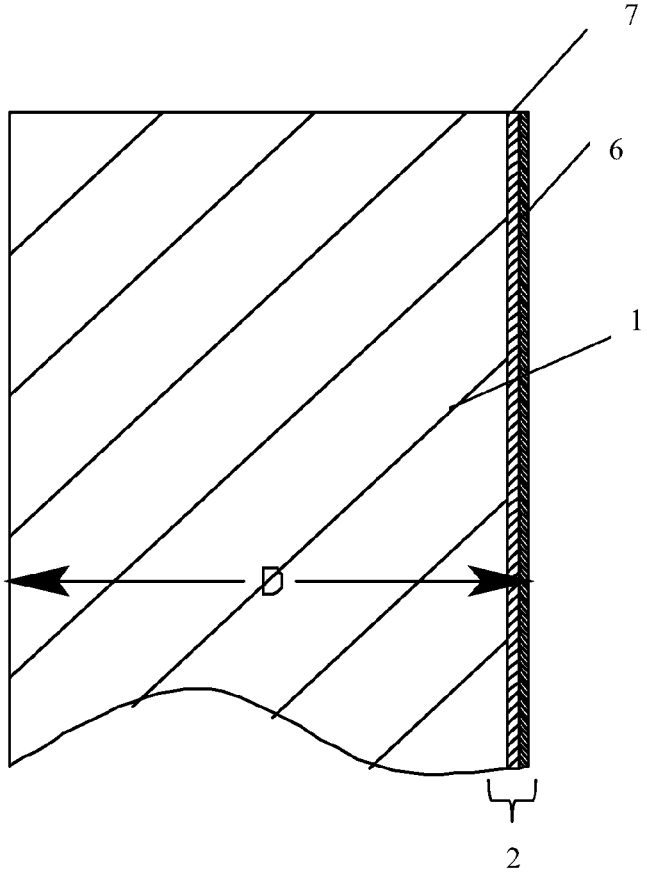

FIG. 2: Floor panel having as structure a carrier material (1) and a decorative top layer (2).

Figure 3:
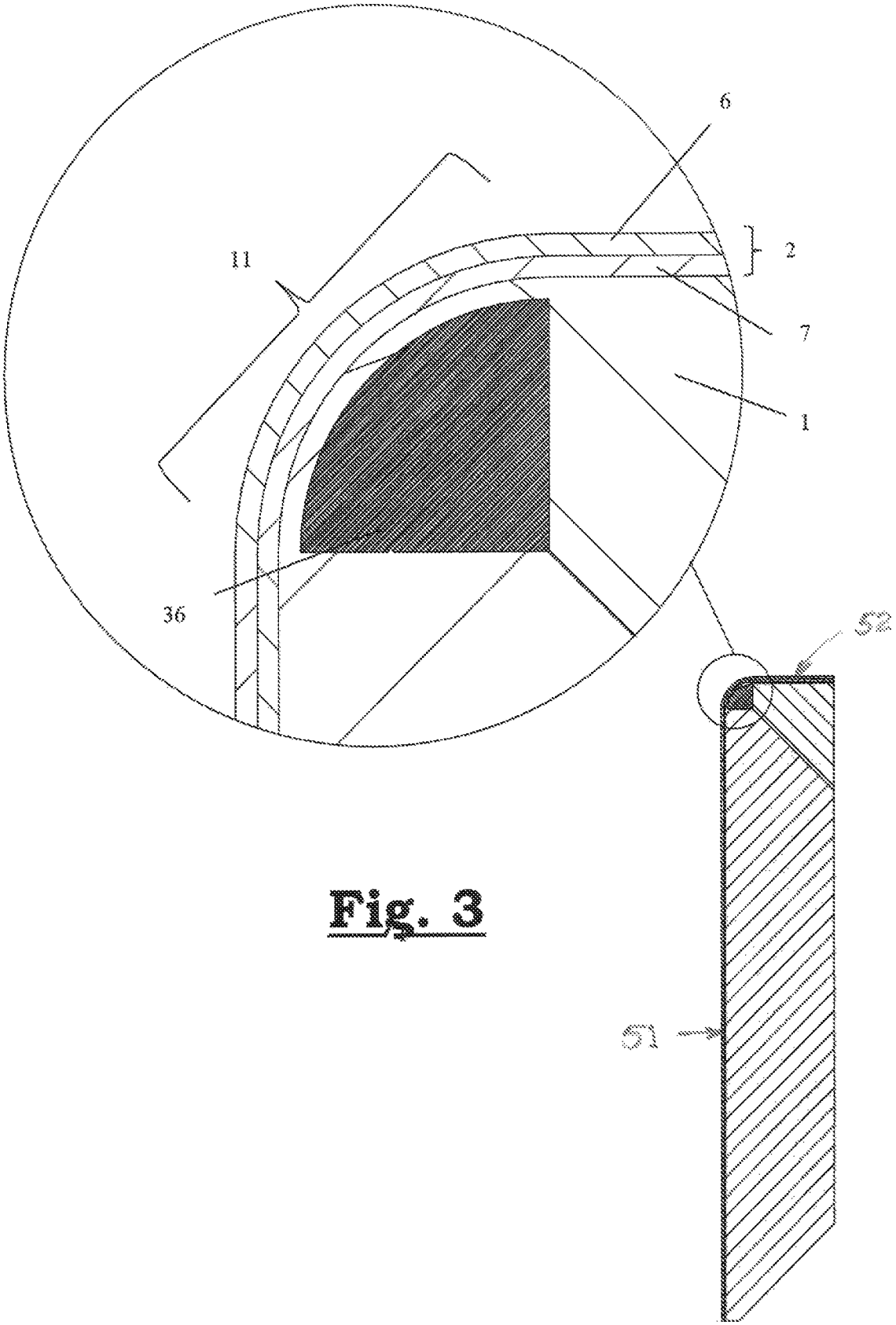

FIG. 3: Skirting board according to the invention. The skirting board is composed of 3 parts, a carrier material (1), a filler (different from the carrier material) and a decorative top layer (2), with the decorative top layer (2) having a rounding or radius (R).

Figure 4:
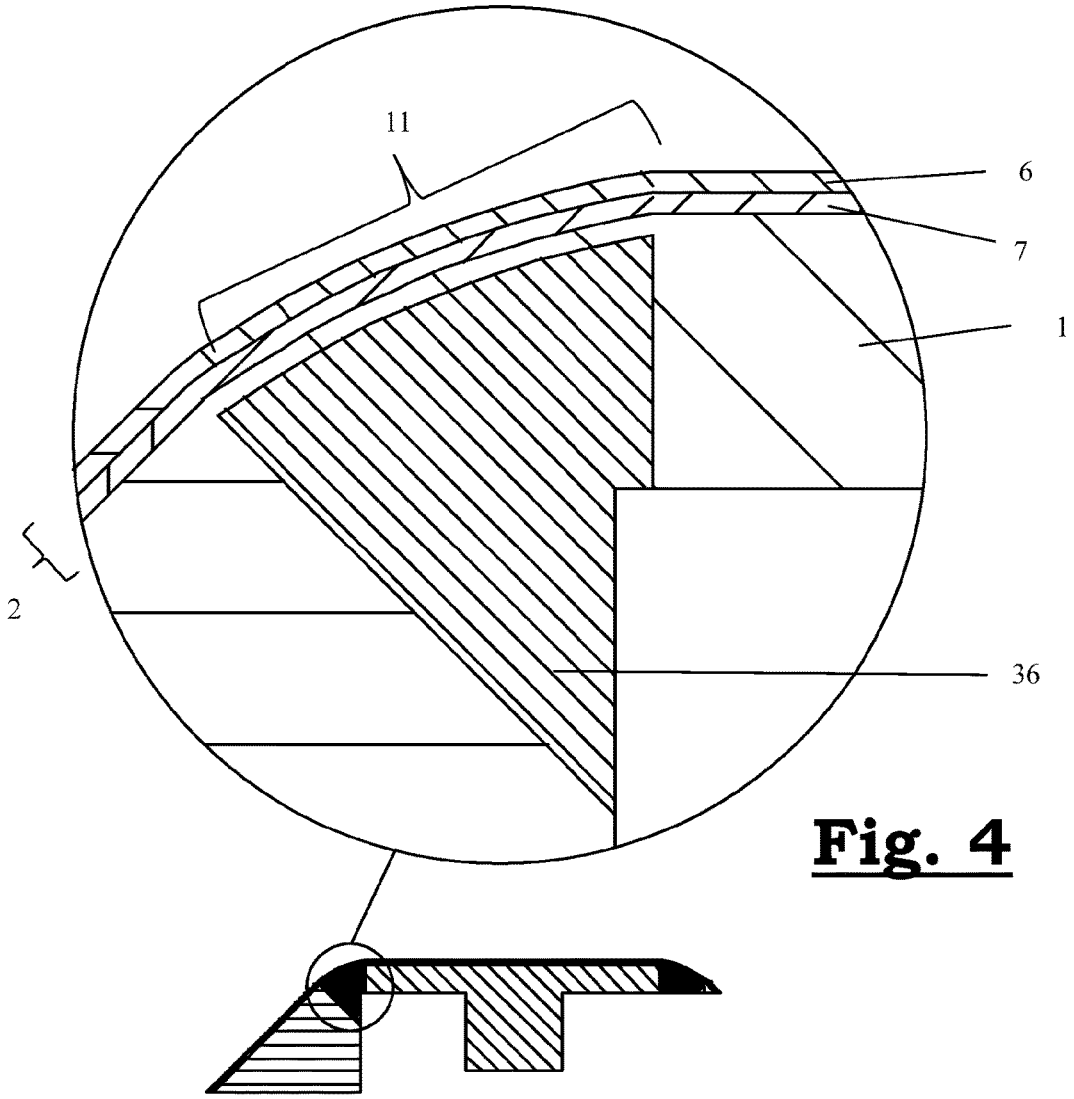

FIG. 4: Finishing profiled section, in particular a transition profiled section which is composed of 3 parts, a carrier material (1), a filler (36) different from the carrier material and a decorative top layer (2), with the decorative top layer (2) having two roundings.

Figure 5:
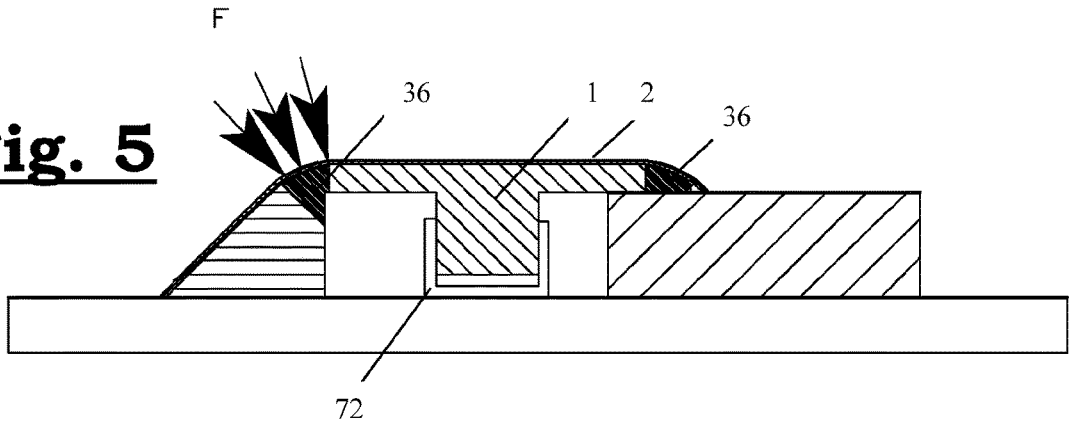

FIG. 5: Finishing profiled section.

Figure 6:
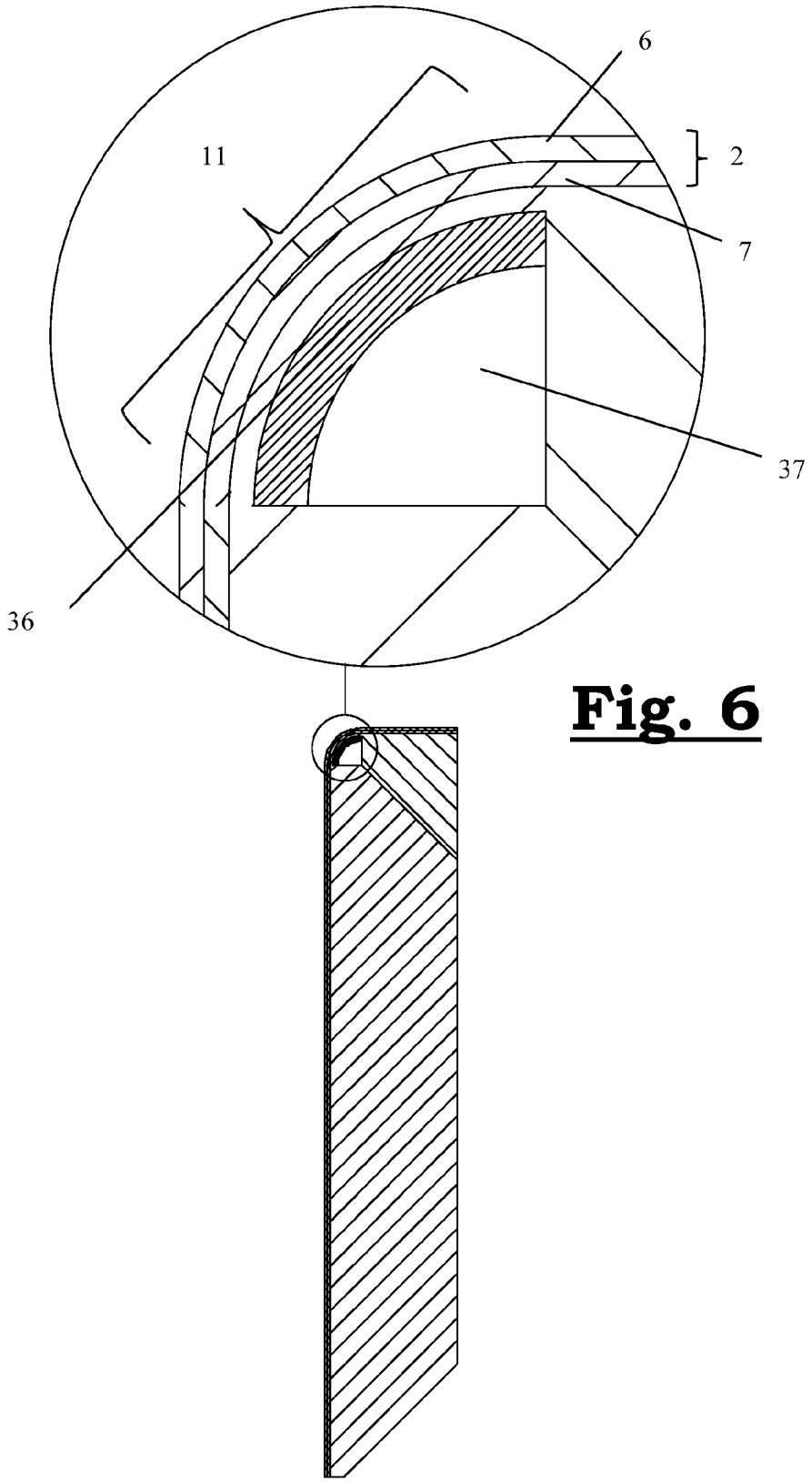

FIG. 6: Skirting board according to the invention.

Figure 7:
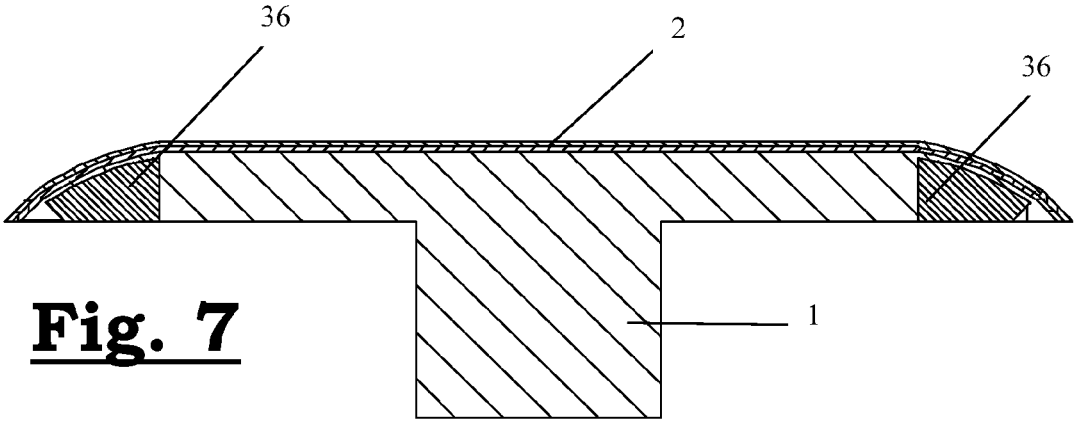

FIG. 7: T profiled section made according to the method according to invention. The T profiled section is composed of 3 parts, a carrier material (1), a filler (36) different from the carrier material and a decorative top layer (2), with the decorative top layer (2) having two roundings.

Figure 8:
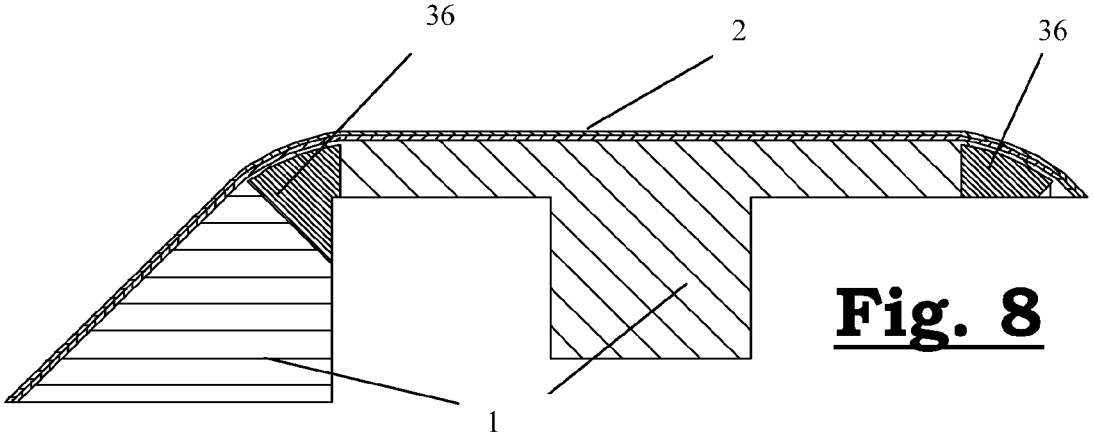

FIG. 8: Adjustment profiled section composed of 3 parts, a carrier material (1), a filler (36) different from the carrier material and a decorative top layer (2), with the decorative top layer (2) having two roundings.

Figure 9:
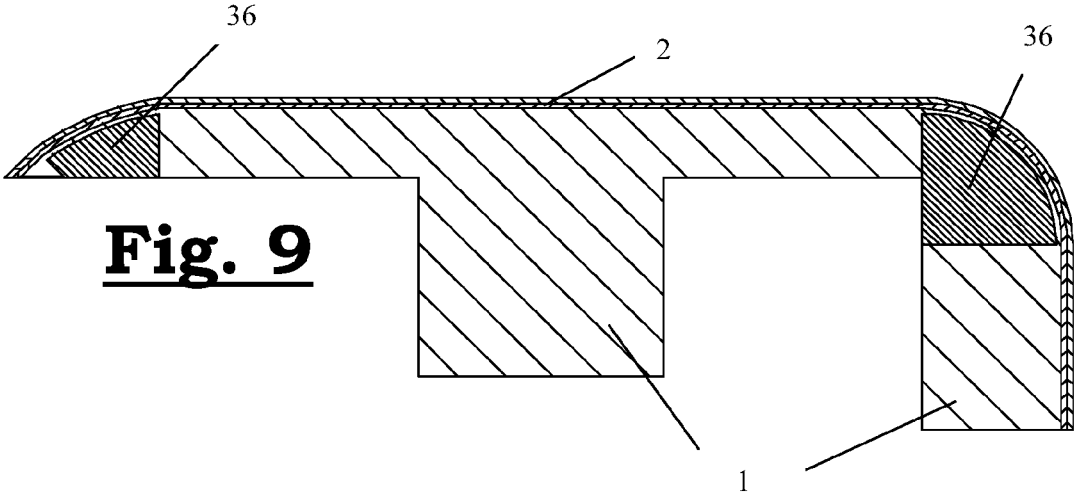
Figure 10A:
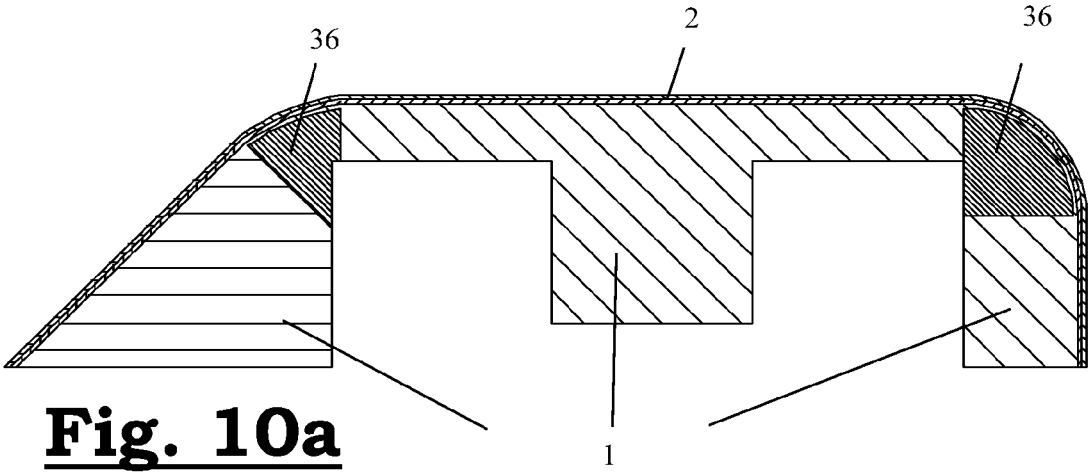
Figure 10B:
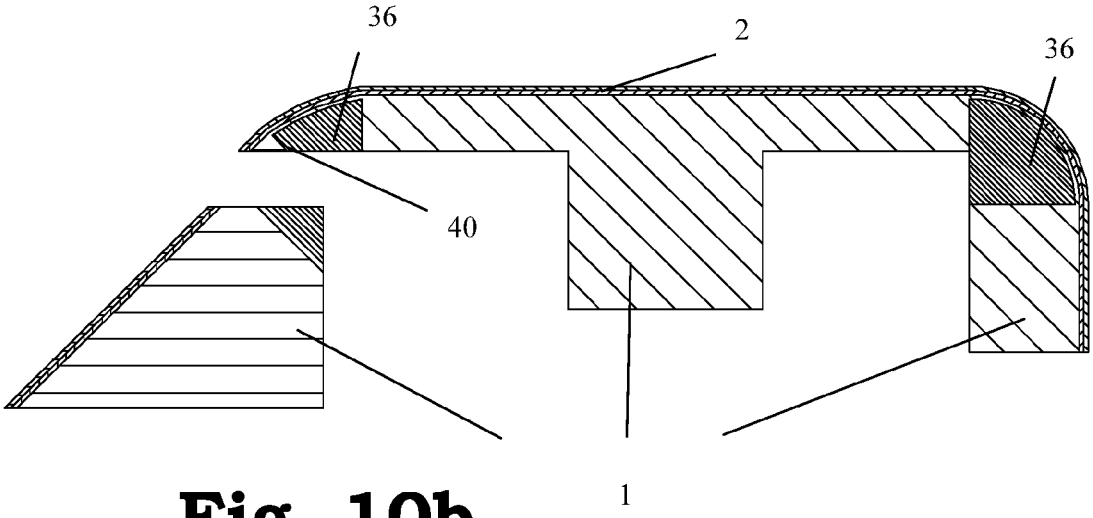
Figure 10C:
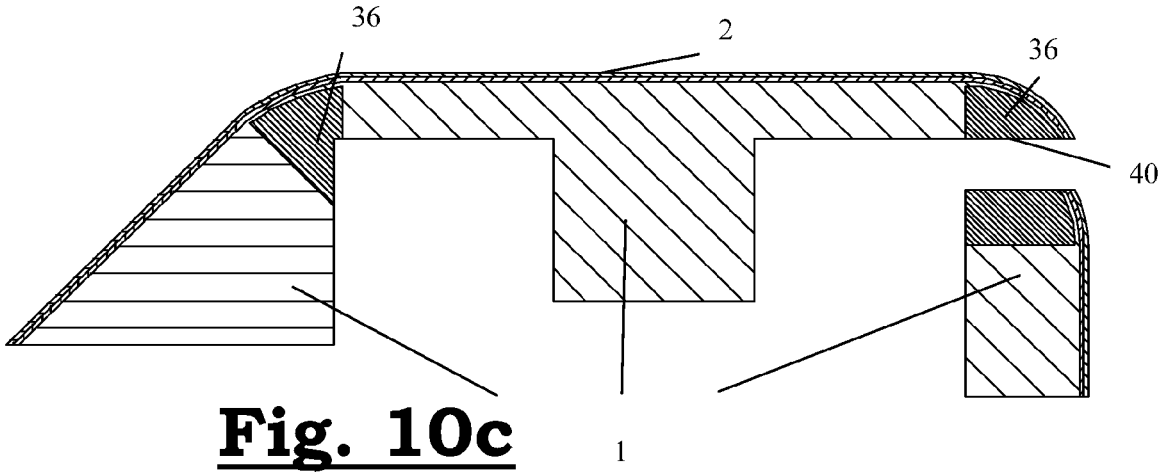
Figure 10D:
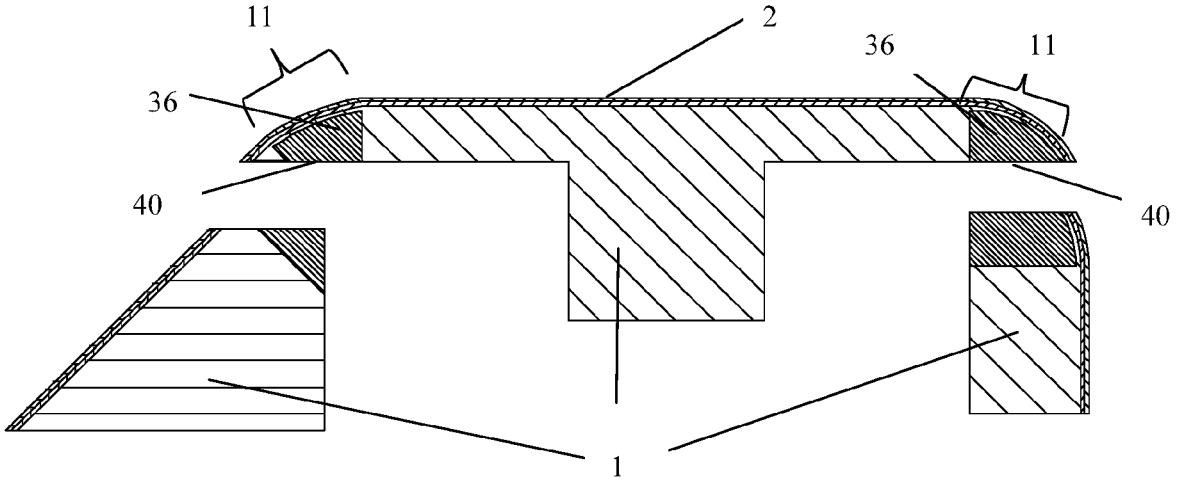

FIG. 9: End profiled section composed of 3 parts, a carrier material (1), a filler (36) different from the carrier material and a decorative top layer (2), with the decorative top layer (2) having two roundings.

FIGS. 10, 10*b*, 10*c* and 10*d*: Multifunctional profiled section (9*a*) composed of 3 parts, a carrier material (1), a filler (36) different from the carrier material and a decorative top layer (2), with the decorative top layer (2) having two roundings.

Figure 11A:
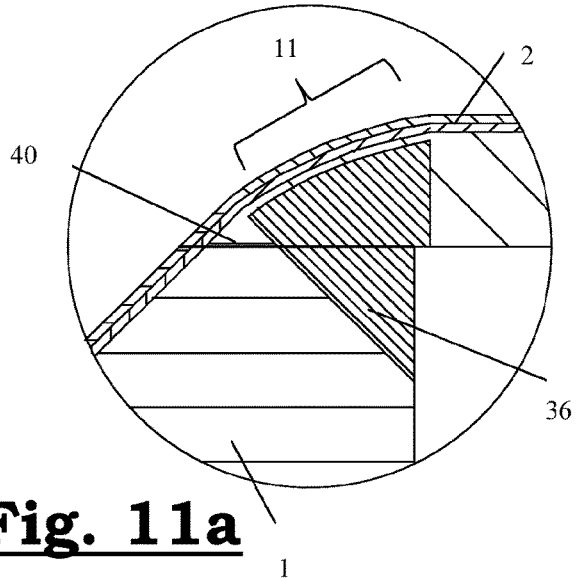
Figure 11B:
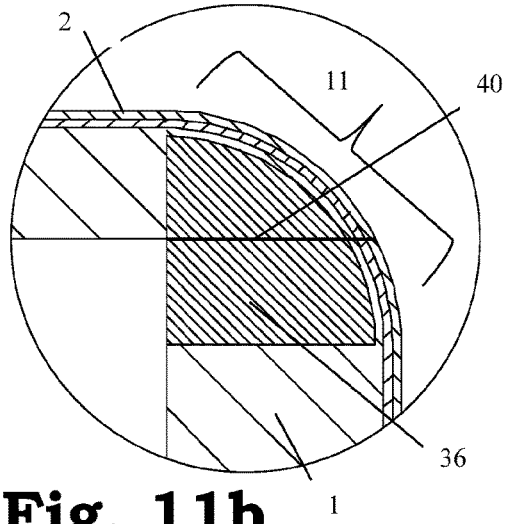
Figure 11C:
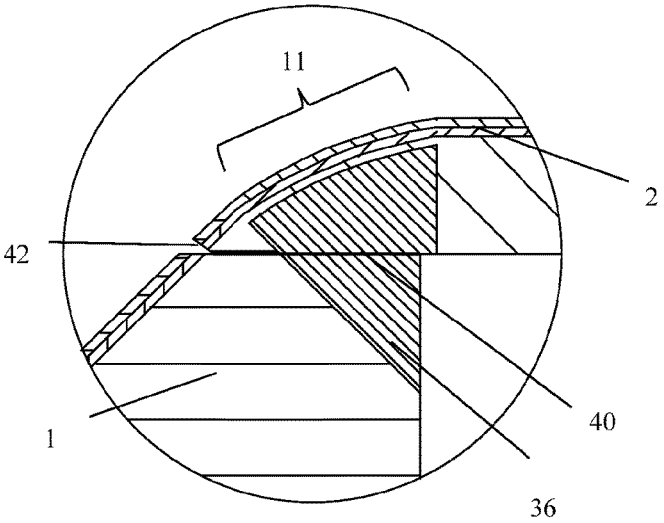
Figure 12A:
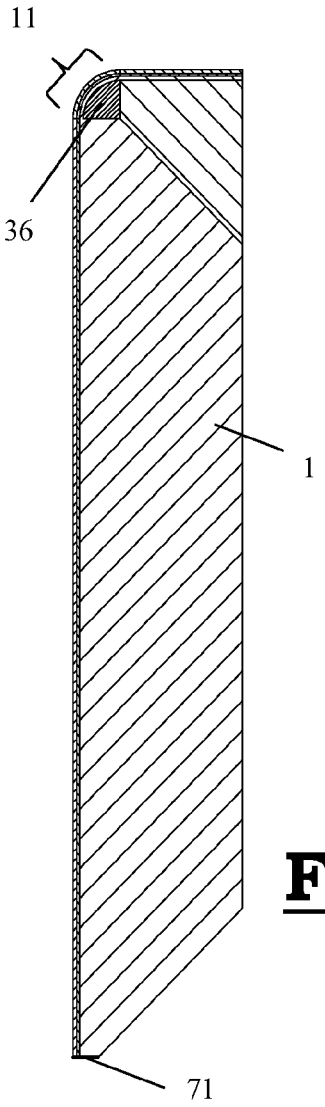
Figure 12B:
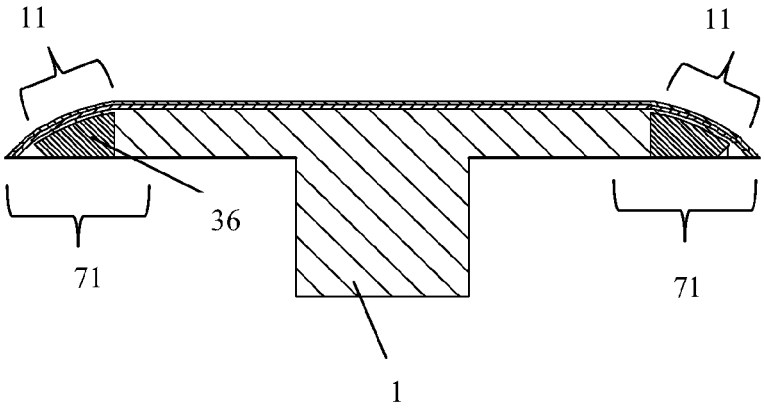

FIGS. 11*a*, 11*b* and 11*c*: Examples of cutting lines (40) to convert a multifunctional profiled section to an adjustment profiled section (9*b*), an end profiled section (9*c*) or a T profiled section (9*d*). Depending on the design of this profile, the cutting line may run through:

FIGS. 12*a* and 12*b*: Finishing profiled section (12*b*) and skirting board (12 *a*) according to the invention.

FIG. 13: Floor panel having a structure as described in FIGS. 1 and 2, with the decorative top layer (2) facing downwards.

FIG. 14: On the rear side of the panel, recesses (16) having a width B are provided.

Figure 15:
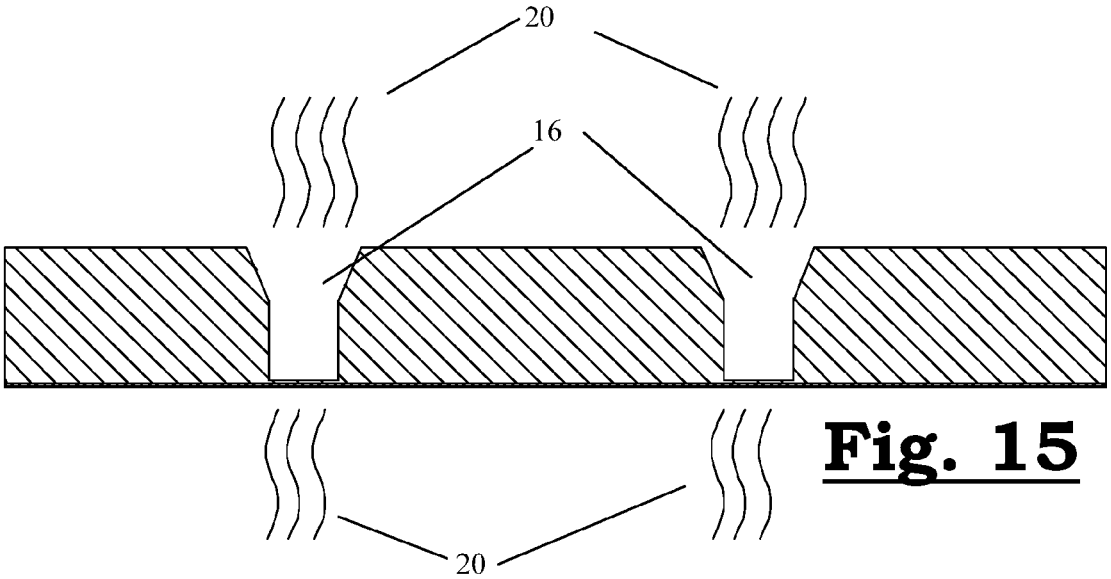

FIG. 15: The residual layers (11) are heated by means of a heat source (20).

Figure 16:
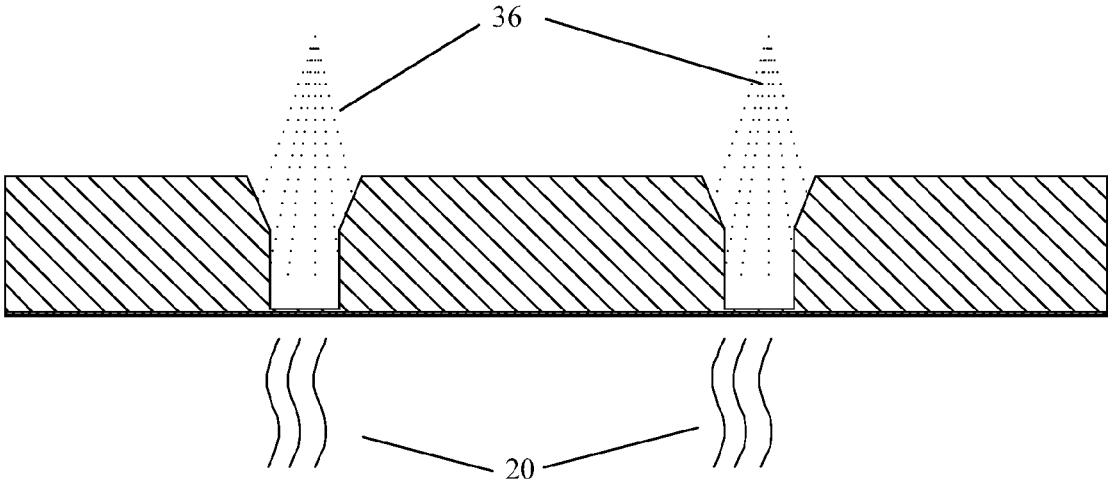

FIG. 16: Glue or adhesive (36) is sprayed into the recesses (16).

Figure 17:
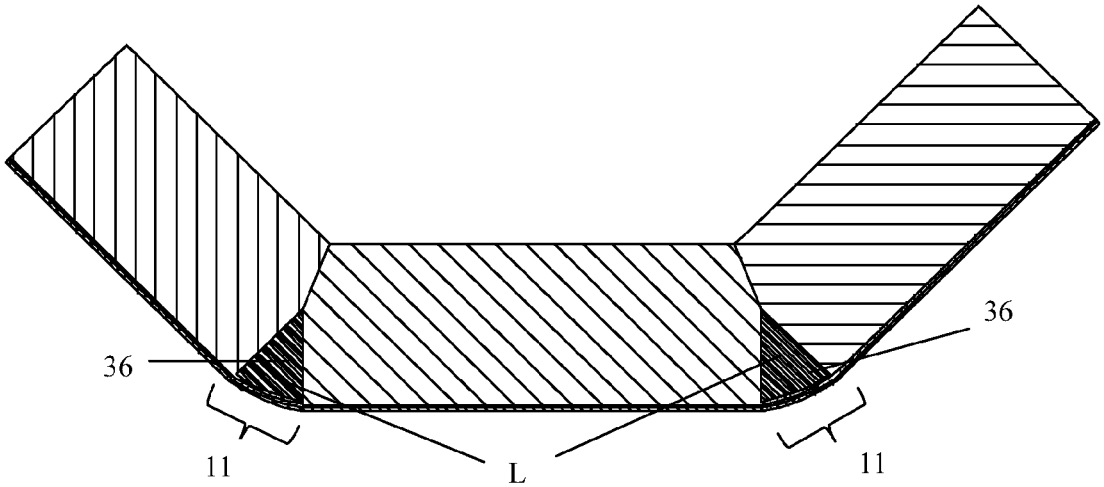

FIG. 17: The residual layers (11) are bent to a certain radius (R). This results in a glue chamber (L) having a volume (V).

Figure 18:
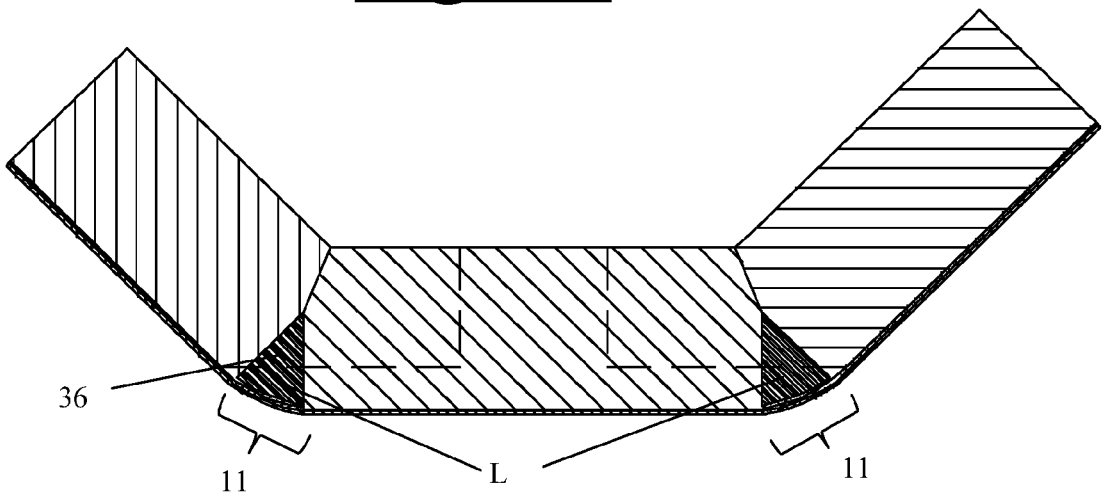
Figure 19A:
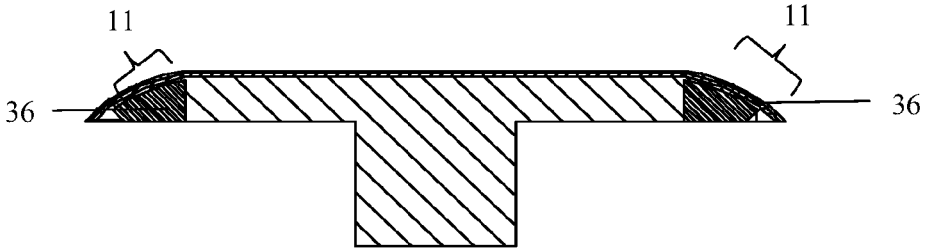
Figure 19B:
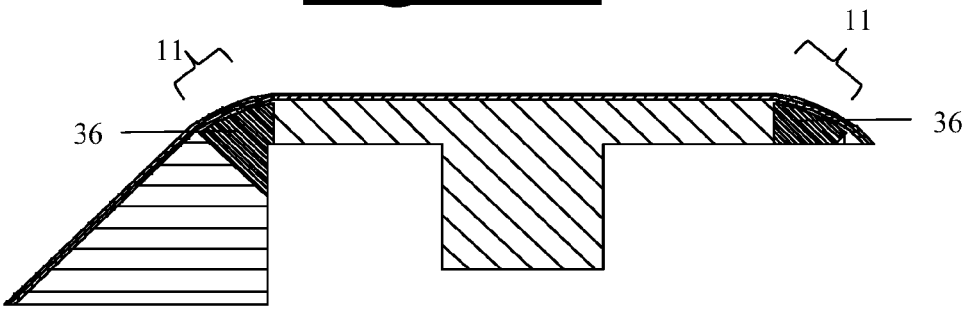
Figure 19C:
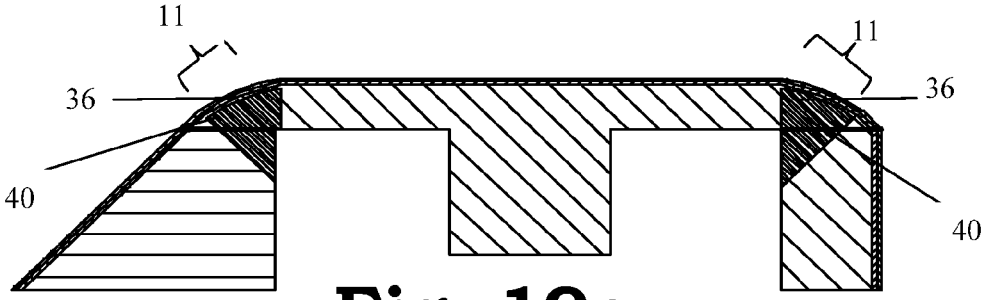
Figure 19D:
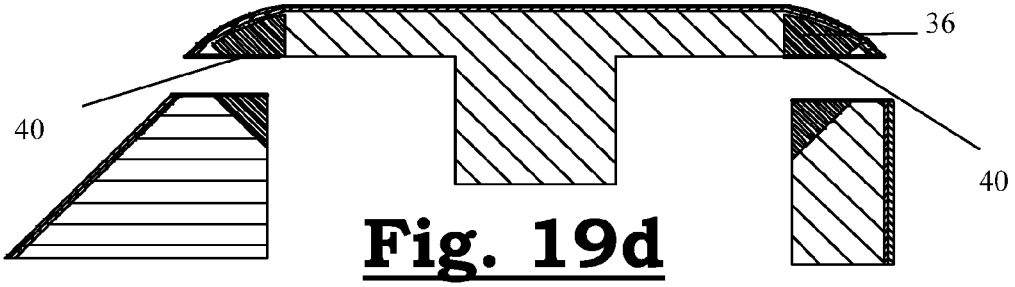

FIG. 18: The resulting profiled section can be processed further until the desired shape is achieved.

FIGS. 19*a*, 19*b*, 19*c* and 19*d*: Using this method, it is thus possible, for example, to a T profiled section (a), a transition profiled section or end profiled section (b) or a multifunctional profiled section (c and d) which is a combination of profiled sections a, b or c, and which may be transformed into each other by means of small manipulations (e.g. cutting).

Figure 20:
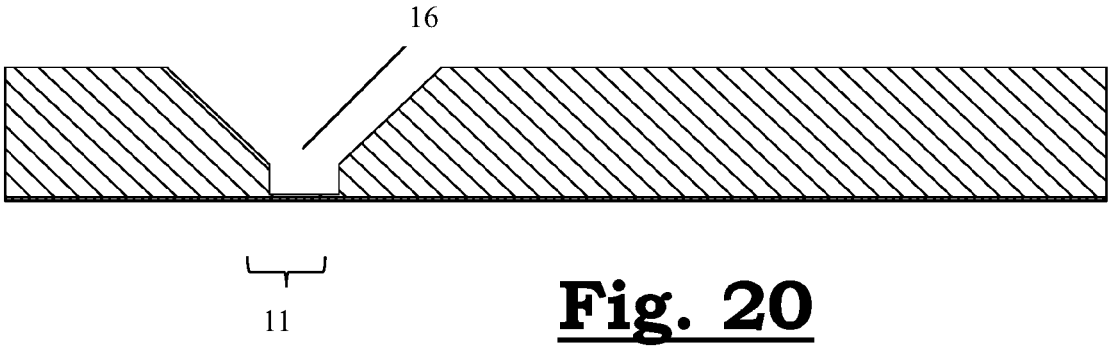

FIG. 20: On the rear side of the panel, recesses (16) having a width B are provided.

Figure 21:
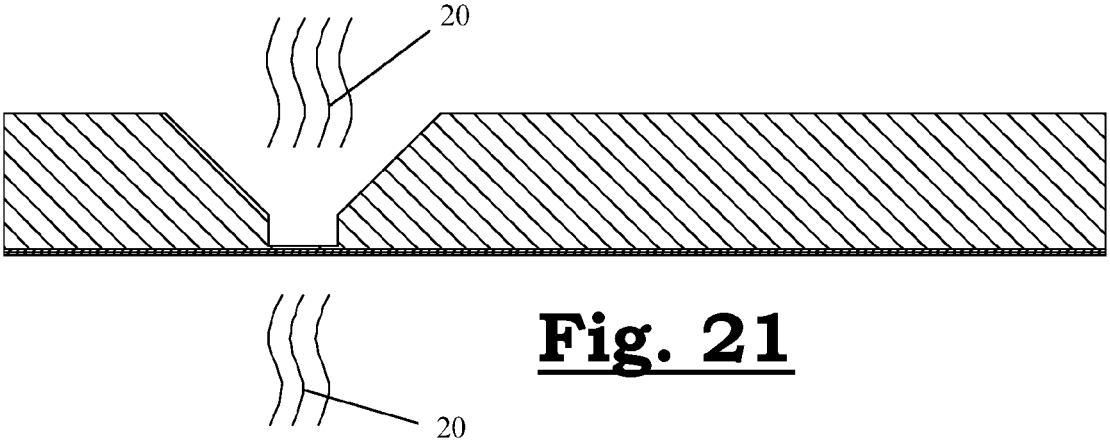

FIG. 21: The residual parts (11) are heated by means of a heat source (20).

Figure 22:
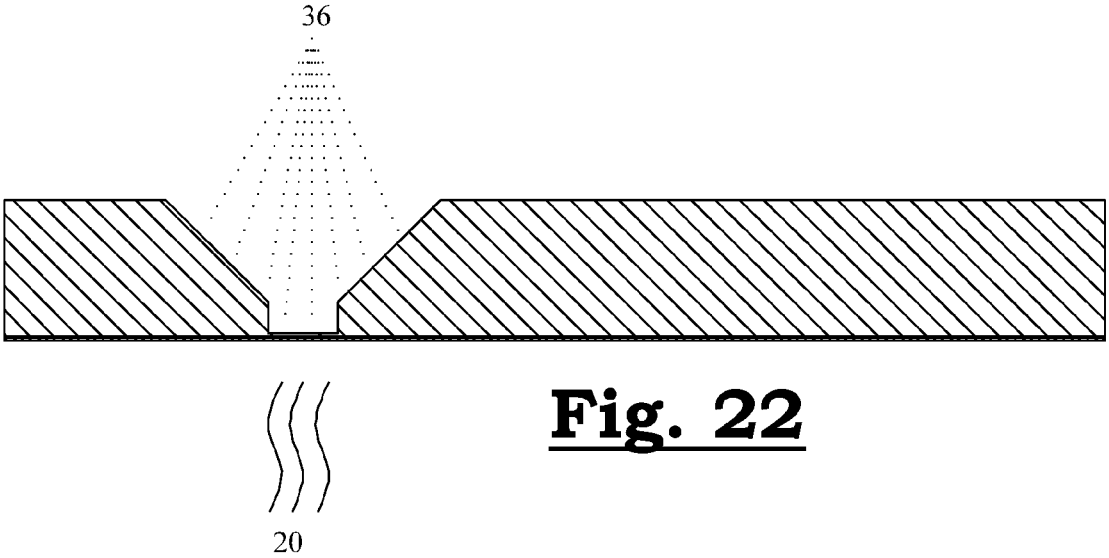

FIG. 22: Glue (36) is sprayed into the recesses (16).

Figure 23:
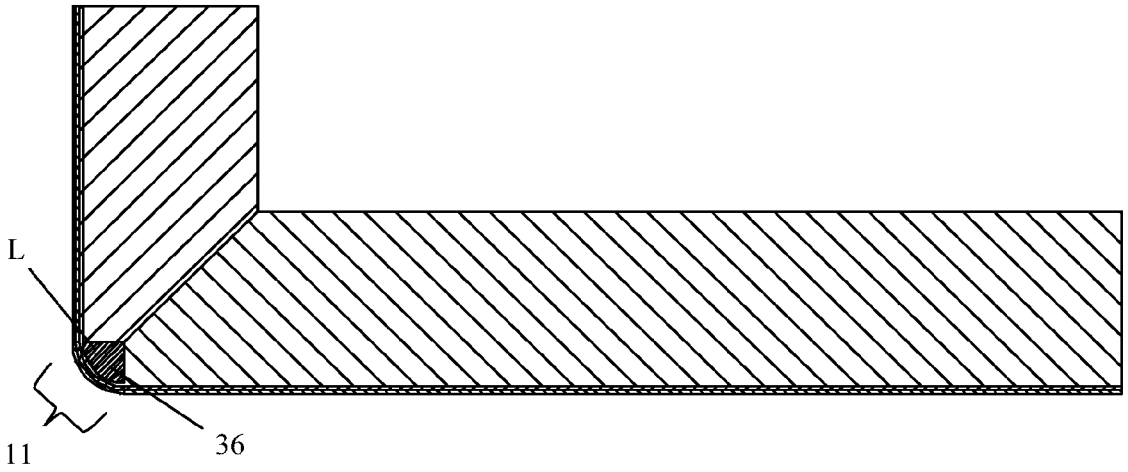

FIG. 23: The residual layers (11) are bent to a certain radius (R).

Figure 24:
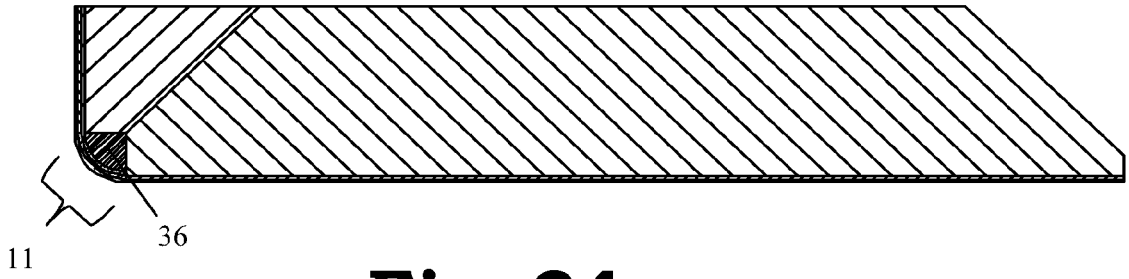

FIG. 24: The resulting profiled section can be processed further until the desired shape is achieved.

FIGS. 25, 26, 27, 28*a*, 28*b*, 28*c*, 29*a*, 29*b*, 29*c*, 29*d*, 30, 31, 32, 33, 34, 35, 36, 37, 38*a*, 38*b*, 38*c*, 39*a*, 39*b*, 39*c*, 39*d*, 39*e* and 39*f*: Further embodiments.

The decorative top layers of DPL and DLP sheet materials are very thin or almost zero. If these top layers are to be bent in a mechanical way, a limited layer of HDF or carrier material will have to remain in the residual part, otherwise this top layer will break or tear immediately. On the other hand, care should be taken not to leave too much carrier material behind, as the thicker the carrier material, the more difficult it will be to bend it. As a result thereof, the radius which is formed on the top side of the skirting board will become increasingly large and would result in it becoming impossible to fold the top side of a skirting board over 90°. Since HDF or wood is not thermoplastic, we will have to rely on the properties of HDF to make folding possible. Nevertheless, it has been shown that a thin layer of HDF becomes more flexible and less brittle when heated up.

The decorative top layer of DPL sheet material has a total thickness of +/−0.2 mm. The decorative paper has a thickness of +/−0.05 mm. For many machines, such tolerances are not achievable. After all, the decorative paper should not be milled through, since otherwise part of the design or print will disappear or develop small tears.

DLP floor panels have no printed paper, but the print is printed directly onto the carrier material. Thus, it is impossible to remove all carrier material to apply a kind of postforming in order to form a skirting board.

Also, the fact that the carrier material has to be milled off across a well-defined width B has to be taken into account. Across this width B, the material is very weak, as a result of which it will vibrate so that the tolerances can no longer be controlled.

This makes it virtually impossible to mill off the carrier material completely as far as the decorative paper. If a thinner layer of carrier material is allowed to remain, the narrowed part is slightly thicker and can thus be better controlled during production.

If milling takes place up to the printed paper which, in combination with the melamine resins, is very brittle, this will cause transverse crackings or tears in the printed paper. This is caused by the fact that the printed paper is completely provided with resins and is thus very brittle, as a result of which it will continuously break or tear due to the vibrations or knocks from the tools. This will result in an aesthetically less appealing product. In order to prevent this, it is also necessary not to mill up to the printed paper, but to allow a bit of carrier material to remain.

The top layer is provided with thermoplastic melamine resins. If the top layer is heated, it becomes less brittle, as a result of which the material in the residual part can be folded to a smaller radius.

The DLP floors have no printed paper layer, but the design is printed directly on the carrier material. They are however provided with a scratch-resistant transparent top layer. Heating this up also has its advantages for folding of the residual part.

As described above, heating up the top layer would have advantages in order to be able to fold the material in the residual part. However, if a certain thickness of HDF carrier material is allowed to remain in the residual part, this will start to burn at a certain temperature. In a first stage, this will become visible on the top layer and in a subsequent stage, the skirting board will start to burn during production, with all the risks this entails. This should be taken into account when heating up the top layer. The DLP floors have no printed paper layer, but the design is printed directly on the carrier material. They are however provided with a scratch-resistant transparent top layer. Heating this up may also have advantages for folding.

This production method is also important for more flexible materials, such as vinyl or LVT, to produce skirting boards or profiled sections. After all, once the profiled section or skirting board has been formed, the flexible part has to be strong, otherwise it may break off during sawing.

At the same time, certain profiled sections are being walked upon, as a result of which the residual part or the bent part has to be very strong. After all, if the residual part is being walked upon, it will be subjected to high loads. Consequently, a filler or adhesive is required to support this residual part.

Therefore, it is important to determine the ideal thickness of the carrier material which is to remain in the residual part. In this case, the following has to be taken into account:

- the thickness of the residual part, it has to be sufficiently strong to be able to perform this procedure completely mechanically and automatically without the residual part breaking.
- the top layer has to be able to withstand impact and it has to be possible to process the former further without it breaking off.
- the residual part still has to be foldable.
- the machine tolerances have to be taken into account, so that the printed paper is not damaged during manufacture of the skirting board.

As has already been indicated, the residual part will be very thin, otherwise it could not be folded over. Once the skirting board has been formed, this zone will therefore be very weak.

It would be possible for this thin residual part to be supported by incorporating an additional carrier material into the profiled section or skirting board. However, this is almost impossible to automate and this also limits the shape of the skirting board or the profiled section.

It is therefore necessary to provide a reinforcement in the form of an adhesive or filler which completely supports the residual part. A filler which can be applied in liquid form as a result of which this can quickly be automated. During cooling, the filler will harden, as a result of which the residual part will be supported.

Consequently, the residual part will become better able to withstand being packaged and will also be less brittle during sawing or further processing.

This adhesive or filler will thus be sprayed into the recesses during production and harden after the residual part has been folded over. As a result, the residual part may in principle assume any shape.

Depending on the requirements on the profiled section or skirting board, a very hard adhesive or an adhesive which remains flexible and elastic may be chosen. This may contribute to the ease of use of the profiled section.

At the same time, the fact that hot-melt adhesives can be reactivated at well-defined temperatures has to be taken into account. This may cause the profiled section or the residual part to become detached under load or at high temperatures. However, this may be solved by using the correct type of adhesive.

An Explanation of the Figures is Given Below:

FIG. 1: Structure of a floor panel containing a carrier material (1), a decorative layer (7), a scratch-resistant top layer (6) and a backing (3). The carrier material may consist of HDF, MDF, LDF, chipboard, PVC, PP, WPC (Wood Plastic Composite), etc.

The decorative layer (7) is a printed film/foil which may be made of paper, PVC or PP film. The scratch-resistant top layer (6) is a transparent layer which protects the floor panel against scratches and dirt. Sometimes, the decorative layer (7) and the scratch-resistant top layer (6) may be the same layer. The decorative layer (7) and the scratch-resistant top layer (6) form the decorative top layer (2). The backing (3) often serves in order to prevent warping.

Depending on the structure, such floor panels are known by the terms DPL (Direct Pressed Laminate) panels, HPL (High Pressed Laminate), CPL (Continuous Pressed Laminate), LVT (Luxury Vinyl Tiles), cushion vinyl, etc.

FIG. 2: Floor panel whose structure comprises a carrier material (1) and a decorative top layer (2).

The decorative film/foil (2) is composed of a decorative film/foil (7) and a scratch-resistant top layer (6). The thickness of the panel is (D).

FIG. 3: Skirting board according to the invention. The skirting board is composed of 3 parts, a carrier material (1), a filler (different from the carrier material) and a decorative top layer (2), with the decorative top layer (2) having a rounding or radius (R). At the location of the rounding, there is a residual part (11) containing a decorative top layer (2) and a thin layer of carrier material (1), in which this residual part (11) is completely supported by the filler (16) and the decorative top layer (2) is continuous at the location of the residual part (11). The decorative top layer (2) consists of a decorative film/foil (7) which is provided with a scratch-resistant top layer (6). The filler (36) may be an adhesive which has 2 functions, i.e. supporting the fragile residual part (11) and gluing all components together. The thickness of the residual part (11) is in the range between 0.1 mm and 1 mm.

FIG. 4: Finishing profiled section according to the invention. The transition profiled section is composed of 3 parts, a carrier material (1), a filler (36) different from the carrier material and a decorative top layer (2), with the decorative top layer (2) having two roundings. At the location of the roundings, there is a residual part (11) containing a decorative top layer (2) and a thin layer of carrier material (1), in which this residual part (11) is completely supported by the filler (16) and the decorative top layer (2) is continuous at the location of the residual part (11). The decorative top layer (2) consists of a decorative film/foil (7) provided with a scratch-resistant top layer (6). The filler (36) may be an adhesive which has 2 functions, i.e. supporting the fragile residual part (11) and gluing all components together. The thickness of the residual part (11) is in the range between 0.1 mm and 1 mm.

FIG. 5: Finishing profiled section according to the invention. The transition profiled section is composed of 3 parts, a carrier material (1), a filler (36) different from the carrier material and a decorative top layer (2), with the decorative top layer (2) having two roundings. At the location of the roundings, there is a residual part (11) containing a decorative top layer (2) and a thin layer of carrier material (1) in which this residual part (11) is completely supported by the filler (16).

Such a transition profiled section is used to walk on and is subjected to numerous loads (F). Since the fragile residual part (11) is completely supported by the filler (36), this will not break under heavy load (F). The filler (36) has 2 functions, i.e. supporting the residual part (11) and gluing the components together. If desired, a more elastic or tough adhesive (36) may be used, so that it also a more damping function, so that it can absorb shocks without breaking.

This profiled section is attached to the ground by means of a PVC attachment part (72).

FIG. 6: Skirting board according to the invention has a first longitudinal side 31 and a second longitudinal side 52. The skirting board is composed of 3 parts, a carrier material (1), a filler (36) different from the carrier material (1) and a decorative top layer (2), with the decorative top layer (2) having a rounding or radius (R). At the location of the rounding, there is a residual part (11) containing a decorative top layer (2) and a thin layer of carrier material (1), in which this residual part (11) is completely supported by the filler (36) and the decorative top layer (2) is continuous at the location of the residual part (11). Contrary to FIG. 3, the residual part (11) is completely supported by a thin layer of filler or adhesive (36). If the residual part (11) is not subjected to too much load, as is the case with a skirting board, this may suffice. In addition to the filler (36), there may thus also be an empty space in the glue chamber (L).

FIG. 7: T-profiled section according to the invention. The T profiled section is composed of 3 parts, a carrier material (1), a filler (36) different from the carrier material and a decorative top layer (2), with the decorative top layer (2) having two roundings. At the location of the roundings, there is a residual part (11) containing a decorative top layer (2) and a thin layer of carrier material (1), in which this residual part (11) is completely supported by the filler (36). A T profiled section serves to provide a transition between 2 floors at the same level.

FIG. 8: Adjustment profiled section according to the invention. The adjustment profiled section is composed of 3 parts, a carrier material (1), a filler (36) different from the carrier material and a decorative top layer (2), with the decorative top layer (2) having two roundings. At the location of the roundings, there is a residual part (11) containing a decorative top layer (2) and a thin layer of carrier material (1), in which this residual part (11) is completely supported by the filler (36). An adjustment profiled section serves to provide a transition between 2 floors having a different level.

FIG. 9: End profiled section according to the invention. The end profiled section is composed of 3 parts, a carrier material (1), a filler (36) different from the carrier material and a decorative top layer (2), with the decorative top layer (2) having two roundings. At the location of the roundings, there is a residual part (11) containing a decorative top layer (2) and a thin layer of carrier material (1), in which this residual part (11) is completely supported by the filler (36). An end profiled section serves to finish a floor against the wall.

FIG. 10: Multifunctional profiled section (10*a*) according to the invention. The multifunctional profiled section (10*a*) is composed of 3 parts, a carrier material (1), a filler (36) different from the carrier material and a decorative top layer (2), with the decorative top layer (2) having two roundings.

At the location of the roundings, there is a residual part (11) containing a decorative top layer (2) and a thin layer of carrier material (1), in which this residual part (11) is completely supported by the filler (16). By means of a cutting tool, certain pieces can be cut off, as a result of which this profiled section can be converted into an adjustment profiled section (10*b*), an end profiled section (10*c*) or a T profiled section (10*d*). The line where the various parts are cut off is the cutting line (40).

FIG. 11: Examples of cutting lines (40) to convert a multifunctional profiled section to an adjustment profiled section (11*b*), an end profiled section (11*c*) or a T profiled section (11*d*). Depending on the design of this profile, the cutting line may run through:

1) Decorative top layer (2), the carrier material (1) and the filler (36) (FIG. 11*a*)
2) The decorative top layer (2) and the filler (36) (FIG. 11*b*)
3) The filler (36) and the carrier material (1) (FIG. 11*c*). In this case, the decorative top layer (2) has already been interrupted (42) before we apply the cut (40). This may have advantages with regard to finish, as the decorative top layer is rather brittle and can produce small pieces during cutting.
4) Only the filler (36). Here as well, the decorative top layer (2) already has an interruption (42) as in FIG. 11*c*.
5) Only the carrier material (1). Here as well, the decorative top layer (2) already has an interruption (42) as in FIG. 11*c*.

Cutting is usually performed by means of a corresponding special knife or cutting tool.

FIG. 12: Finishing profiled section (12*b*) and skirting board (12*a*) according to the invention. The bottom side of this skirting board (12*a*) or finishing profiled section (12*b*) is provided with a water-impermeable film (71). This film may be a wax, a PVC film, a paraffin layer or a hardened adhesive.

FIG. 13: Floor panel with a structure as described in FIGS. 1 and 2, with the decorative top layer (2) facing downwards.

FIG. 14: On the rear side of the panel, recesses (16) having a width B are provided. Across this width B, a residual layer (11) is created which is composed of the decorative film/foil (6), the scratch-resistant top layer (7) and a very thin layer of carrier material (1). The total thickness of the residual layer (11) is D. The sides of the recesses (16) may be rounded or angular. It may also be the case that the thickness D of the residual layer (11) is not constant across the entire width (B).

FIG. 15: The residual layers (11) are heated by means of a heat source (20). This heat source may consist of lamps, air blowers, etc. As a result thereof, the residual layers (11) are more flexible and less brittle.

FIG. 16: Glue or adhesive (36) is sprayed into the recesses (16). Also, the residual parts (11) are heated (20) as well. This glue may be a hot-melt adhesive, a PUR glue or a polyolefin glue, depending on the desired properties of the skirting board. The amount of adhesive (36) which is sprayed into the recess (16) depends on the volume (V) which is created in the glue chamber (L) after bending of the residual layer (11).

FIG. 17: The residual layers (11) are bent to a certain radius (R). This creates a glue chamber (L) having a volume (V). Since the residual layer (11) is often very fragile, it is very important that the residual layer (11) be completely supported by the adhesive or filler (36) with which the glue chamber (L) is filled.

FIG. 18: The resulting profiled section can be processed further until the desired shape is obtained.

FIG. 19: Using this method, it is thus possible, for example, to a T profiled section (a), a transition profiled section or end profiled section (b), or a multifunctional profiled section (c and d) which is a combination of profiled sections a, b or c, and which may be transformed into each other by means of small manipulations (e.g. cutting). During this cutting, a cutting line (40) is formed along which the knife has to run in order to convert the multifunctional profiled section into a transition, T profiled section or end profiled section.

FIG. 20: On the rear side of the panel, recesses (16) having a width B are provided. Across this width B, a residual layer (11) is created which is composed of the decorative film/foil (6), the scratch-resistant top layer (7) and a very thin layer of carrier material (1). The total thickness of the small residual layer (11) is D. The sides of the recesses (16) may be rounded or angular. It may also be the case that the thickness D of the residual layer (11) is not constant across the entire width (B).

FIG. 21: The residual parts (11) are heated by means of by means of a heat source (20). This heat source may consist of lamps, air blowers, etc. As a result thereof, the residual parts (11) are more flexible and less brittle.

FIG. 22: Glue (36) is sprayed into the recesses (16). Also, the residual parts (11) are heated (20) further. This glue may be a hot-melt adhesive, a PUR glue or a polyolefin glue, depending on the desired properties of the skirting board. The amount of glue (36) which is sprayed into the recess (16) depends on the volume (V) which is created in the glue chamber (L) after bending of the residual part (11).

FIG. 23: The residual layers (11) are bent to a certain radius (R). This creates a glue chamber (L) having a volume (V). Since the residual layer (11) is often very fragile, it is very important that the residual layer (11) be completely supported by the adhesive or filler (36) with which the glue chamber (L) is filled.

FIG. 24: The resulting profiled section can be processed further until the desired shape is obtained.

Figure 25:
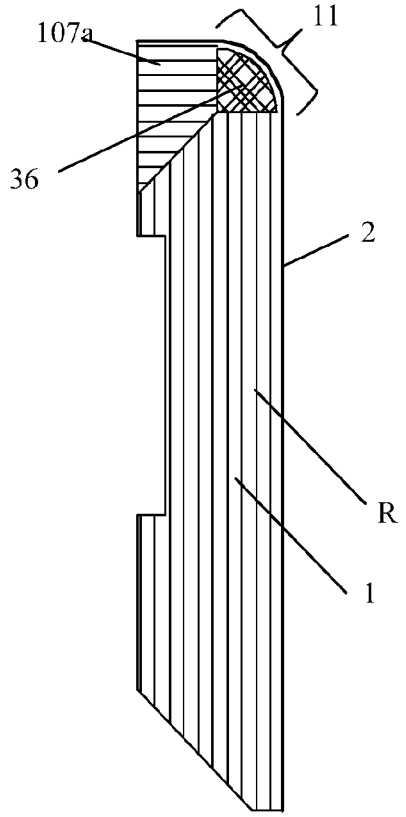

FIG. 25: Skirting board for a wall of a space comprising a body composed of a carrier material (1) with a well-defined fibre and/or layer direction (R) and a decorative top layer (2), in which said body comprises a longitudinal part (3) which forms at least a part of the front side of the skirting board or finishing profiled section, and a top and/or bottom part (107*a*, 107*b*) which forms at least a part of the top and/or bottom side of the skirting board or finishing profiled section, in which the transition (11*a*, 11*b*) between the longitudinal part and the top and/or bottom part has a mainly curved configuration. At the location of said transition (11*a*, 11*b*), some of the carrier material has been replaced by a filler. At the location of the transition (11), the decorative top layer (2) is continuous. This decorative top layer may be a CPL, an HPL, a PVC, a paper (optionally provided with resin), an LVT or another plastic. In the transition (11) below the decorative top layer (2), there is also a residual layer of carrier material (1), the aforementioned fibre and/or layer direction (R) of the carrier material (1) of the longitudinal part and the top and/or bottom part runs parallel with the direction of the coating layer (2). The carrier material (2) may be an MDF, an LDF, a wood-based sheet material, a multi-layered plastic panel, such as e.g. an LVT floor panel having one or several layer(s) of glass fleece or glass fibre in the centre.

Figure 26:
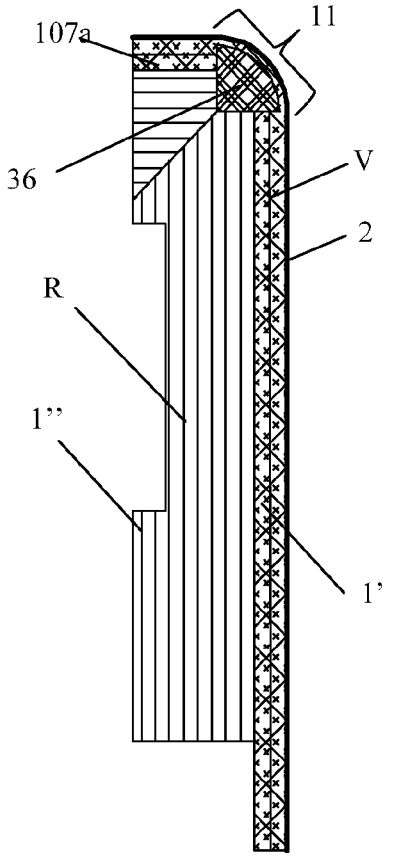

FIG. 26: Skirting board for a wall of a space comprising a body composed of a carrier material (1) with a well-defined fibre and/or layer direction (R) and a decorative top layer (2), in which said body comprises a longitudinal part (3) which forms at least a part of the front side of the skirting board or finishing profiled section, and a top and/or bottom part (107*a*, 107*b*) which forms at least a part of the top and/or bottom side of the skirting board or finishing profiled section, in which the transition (11*a*, 11*b*) between the longitudinal part and the top and/or bottom part has a mainly curved configuration. At the location of said transition (11*a*, 11*b*), some of the carrier material has been replaced by a filler (36). At the location of the transition (11), the decorative top layer (2) is continuous. This decorative top layer may be a CPL, an HPL, a PVC, a paper (optionally provided with resin), an LVT or another plastic. In the transition (11) below the decorative top layer (2), there is also a residual layer of carrier material (1), the aforementioned fibre and/or layer direction (R) of the carrier material (1) of the longitudinal part and the top and/or bottom part runs parallel with the direction of the coating layer (2). The carrier material (1' and 1") may be an MDF, an LDF, a wood-based sheet material or a multi-layered plastic panel. In FIG. 2, the skirting board is composed of 2 different types of carrier materials (1' and 1"). This may have certain advantages with regard to processability. Thus, the carrier material 1' which is just under the coating layer (2) may be thermoplastic, as a result of which it is bendable. Also, the thermoplastic carrier material 1', together with the coating layer (2), may continue as far as the ground, thus making the skirting board waterproof.

Figure 32:
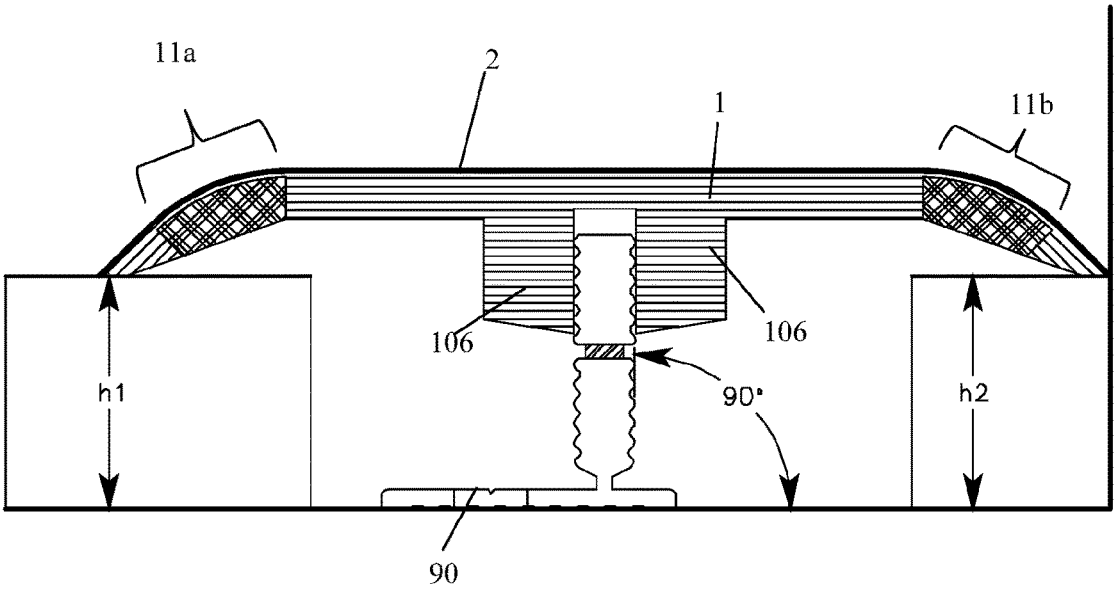
Figure 33:
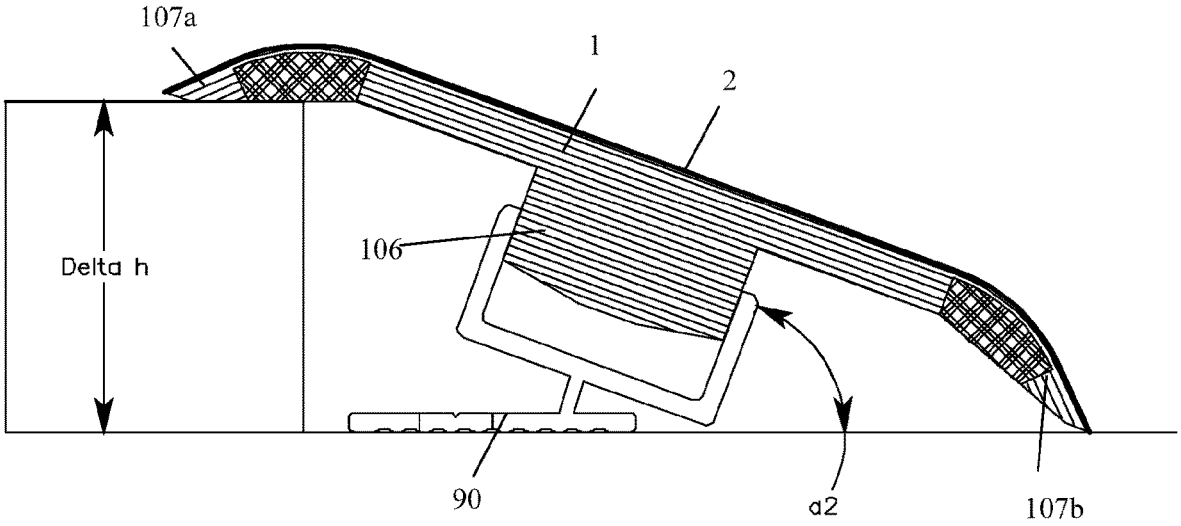

FIG. 27: Multifunctional profiled section for floor covering according to the invention. This multifunctional finishing profiled section comprises a body which is composed of several parts (3, 6, 107*a*, 107*b*) made from a carrier material having a well-defined fibre and/or layer direction. The various parts of this body are a flange-shaped part (3), an attachment part (106) for the finishing profiled section and two nose parts (107*a*, 107*b*) which extend underneath the flange-shaped part (3), in which the flange-shaped part (3) and the nose parts (107*a*, 107*b*) are at least partly provided with a coating layer (2). The coating layer (2) at the location of the transition between the flange-shaped part (3) and the nose parts (107*a* and 107*b*) has a bent shape, in which some of the carrier material (1) has at least partly been replaced by a filler (36) having a different composition than the carrier material (1) at the location of said transition (11*a*; 11*b*). This filler (36) makes the coating layer (2) more resistant to impact against heavy loads. At the same time, the filler (36) has to be sufficiently strong to be able to withstand any tensile forces between the nose parts (107*a*, 107*b*) and the flange-shaped part. The nose parts (107*a*, 107*b*) extend far below the flange-shaped part (2). This is necessary because the profiled section has to be multifunctional, as a result of which it must be able to serve as a T profiled section (FIG. 31), as a reducer (FIG. 32) and as an end profiled section (FIG. 33). It can be seen in FIGS. 31,32,33 that the profiled section can be used for different applications or finishes by fitting the profiled section at a different angle (a1). To this end, it cooperates with a fastening profiled section which is tiltable or rotatable (FIG. 32).

FIG. 28*a*: Shows a profiled section having the same shape as the profiled section according to the invention (1), this profiled section being made from a layer-shaped panel or a panel having a distinct fibre direction or layer direction, but in a traditional manner, i.e. profiling this shape out of a panel. As a result thereof, the layer direction of the carrier material (1) in the nose parts (107*a*, 107*b*) runs horizontally, just as in the flange-shaped part (3). Since the bond between the various layers to each other is much weaker than in the direction of layers themselves, these nose parts (107*a*, 107*b*) will break quickly under load (FIG. 28*b*).

FIG. 28*b*: Profiled section according to FIG. 28*a*, in which this figure is fitted and subjected to a load (F1). This results in a tensile force at right angles to the layers (F2) in the nose part (107*b*), as a result of which some of these layers will split or be pulled apart. The shorter the fibres, the weaker the nose part will be and the quicker the layers will be pulled apart.

Figure 28C:
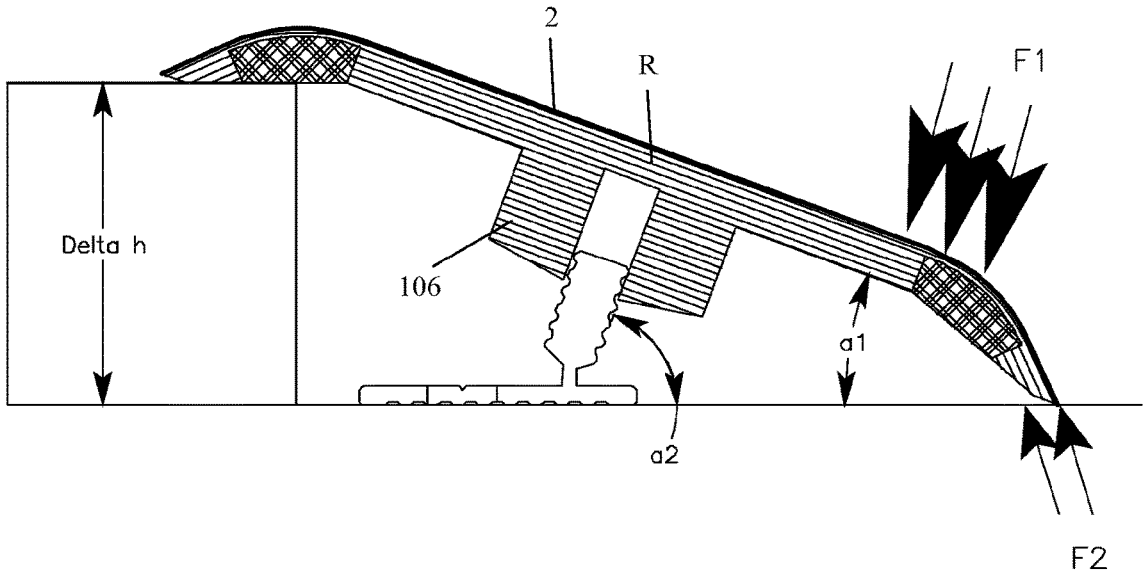

FIG. 28*c*: Multifunctional profiled section according to the invention. This profiled section is fitted in the same way as the profiled section described in FIG. 28*b*. As the direction of the fibres or layers now runs parallel with the coating layer (2), the forces (F2) under load (F1) manifest in the same direction as the fibres, as a result of which the profiled section is much stronger and will no longer break. The folding technique also makes the fibres in the nose part longer, as a result of which the bond becomes stronger. Forces also manifest under load (F1) around the filler or adhesive (36), therefore it is very important to use the correct adhesive or filler. This may be, e.g., a PUR glue, a PO glue or a hot-melt adhesive, depending on the requirements and carrier materials (1). Also, the filler may be a solid material which may be formed from the carrier material itself or from another material. With well-defined materials, if the residual layer of carrier material is still thick and consequently sufficiently strong, this filler in the space just under the carrier material may also be omitted. The residual layer is then no longer supported by the filler.

Figure 29A:
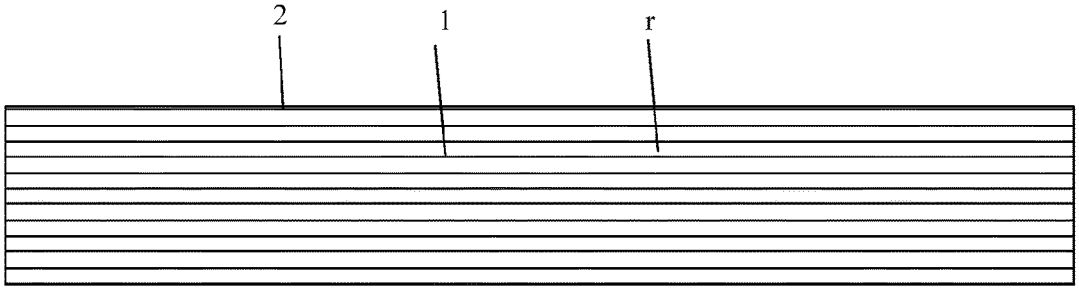

FIG. 29*a*: Panel with coating layer (2) from which the profiled section of the invention is made. This panel has a well-defined layer and/or fibre direction. This fibre direction is indicated by the direction of the hatching and is thus parallel with the coating layer (2). Such a panel may be a chipboard, an MDF, LDF, HDF, plywood or another wood-based panel. Usually, these fibres are relatively short (MDF, chipboard), but they all face in the same direction.

Figure 29B:
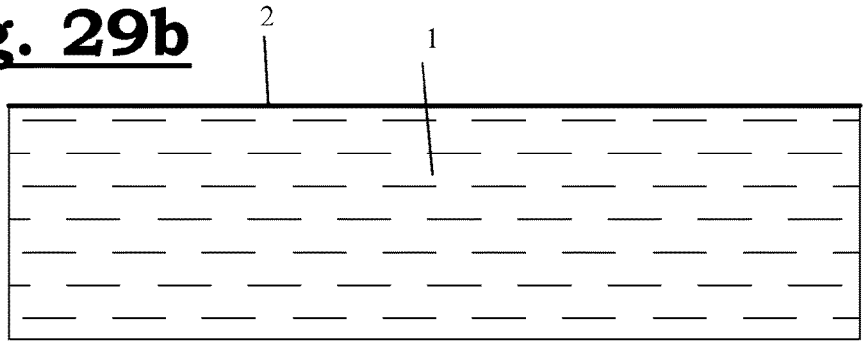

FIG. 29*b*: A panel from which the profiled section of the invention can be made. Such a panel may be a chipboard, an MDF, LDF, HDF, plywood or another wood-based panel. Usually, these fibres are relatively short (MDF, chipboard), but they all face in the same direction. The shorter the fibre, the weaker the bond between the various layers. Thus, the profiled section may be made from a DPL, a DLP, a CPL or an HPL panel. However, the present invention is not limited to profiled sections which are made from a wood-based sheet material.

FIG. 29*c*: A panel from which the profiled section of the invention can be made. This panel is a plastic panel which is composed of various layers. Thus, we recognise the wear layer (1*b*), the decorative layer (1*a*), a support plate (2*c*), a glass fibre (2*b*) and another support plate (2*a*) as backing. The support plates (2*c* and 2*a*) are composed of plastic. The glass fibre (2*b*) serves as a reinforcement for the panel and makes the panel thermally more stable and also more resistant to bending. This is a simple construction, thus several glass fibres may be present or there may be several wear layers, depending on the required scratch resistance. Also, the decorative layer (1*a*) is printed directly onto the glass fibre (2*b*). On the market, these panels are known under the name of LVT (Luxury Vinyl Tiles) or vinyl tiles. Other forms of plastic floors are also possible.

FIG. 29*d*: Panel as discussed in FIG. 3*c*, but in split view. This panel is a plastic panel which is composed of different layers. Thus, we recognise the wear layer (1*b*), the decorative layer (1*a*), a support plate (2*c*), a glass fibre (2*b*) and another support plate (2*a*) as backing. The support plates (2*c* and 2*a*) are composed of plastic. The glass fibre (2*b*) serves as a reinforcement for the panel and makes the panel thermally more stable and also more resistant to bending. This is a simple construction, thus several glass fibres may be present or there may be several wear layers, depending on the required scratch resistance. Also, the decorative layer (1*a*) is printed directly onto the glass fibre (2*b*). On the market, these panels are known under the name of LVT (Luxury Vinyl Tiles) or vinyl tiles. Other forms of plastic floors are also possible (PVC, PP, etc.). Combinations, such as e.g. an MDF carrier with an LVT glued thereto, are also possible.

Figure 30:
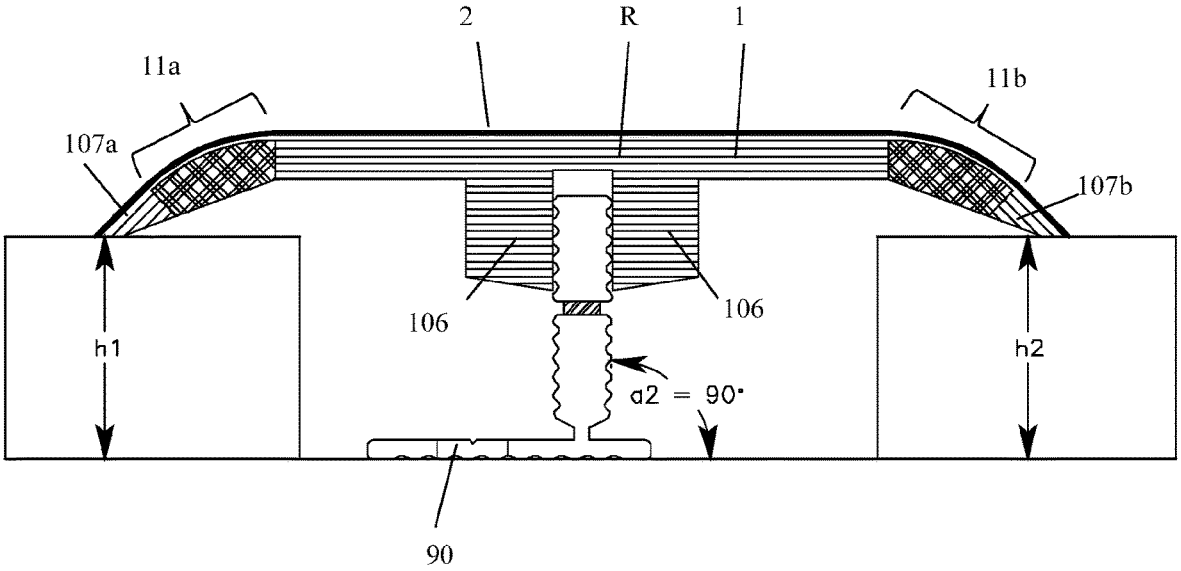

FIG. 30: Multifunctional profiled section for floor covering according to the invention. This multifunctional finishing profiled section comprising a body which is composed of several parts (3, 6, 107*a*, 107*b*) made from a carrier material with a well-defined fibre and/or layer direction, which comprises a flange-shaped part (3), an attachment part (6) for the finishing profiled section and two nose parts (107*a*, 107*b*) extending below the flange-shaped part (3), in which the flange-shaped part (3) and the nose parts (107*a*, 107*b*) are at least partly provided with a coating layer (2).

The profiled section is in the fitted position and serves as a transition between 2 floors having the same height (h1=h2). As a result thereof, the angle at which the attachment part is arranged a2=90°. If a difference in height has to be bridged, the angle will be greater or smaller than 90°. This is possible because fitting takes place by means of a fastening pin (90) which can rotate. It should be understood that the present invention is not limited to a multifunctional profiled section which is fastened by means of a fastening pin (90). Thus, the profiled section may also be fastened by means of a U profiled section. Such a profiled section is known on the market as a T profiled section.

Figure 31:
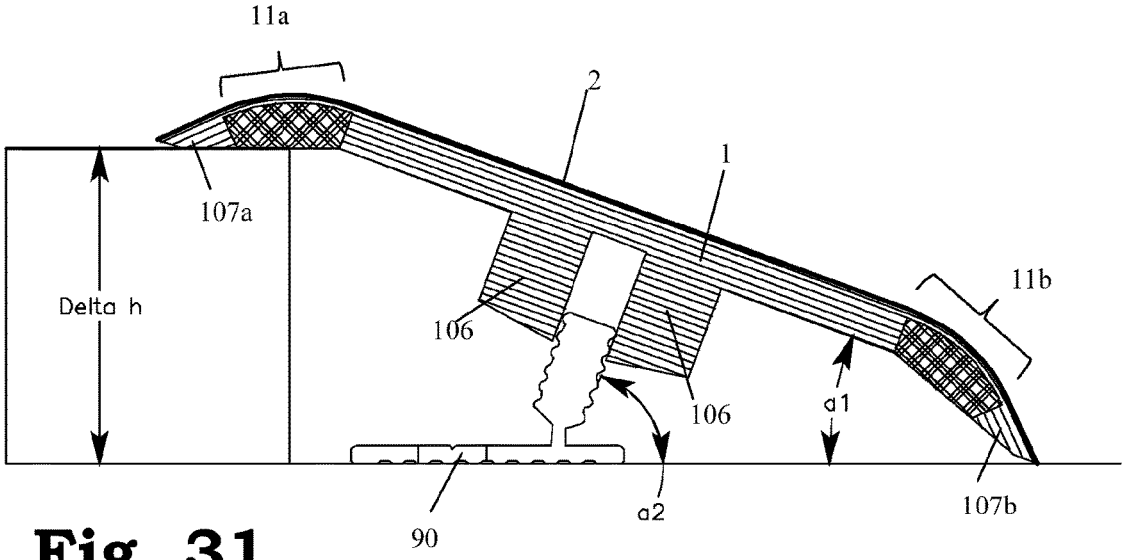

FIG. 31: Multifunctional profiled section for floor covering according to the invention. This multifunctional finishing profiled section comprising a body which is composed of several parts (3, 6, 107*a*, 107*b*) made from a carrier material with a well-defined fibre and/or layer direction, which comprises a flange-shaped part (3), an attachment part (6) for the finishing profiled section and two nose parts (7*a*, 7*b*) extending below the flange-shaped part (3), in which the flange-shaped part (3) and the nose parts (7*a*, 7*b*) are at least partly provided with a coating layer (2).

The profiled section is in the fitted position and serves as a transition between 2 floors having a different height. As a result thereof, the angle at which the attachment part is arranged a2≤90°. This is possible because fitting takes place by means of a fastening pin (90) which can rotate. It should be understood that the present invention is not limited to a multifunctional profiled section which is fastened by means of a fastening pin (90). Thus, the profiled section may also be fastened by means of a U profiled section.

Such an arrangement is known on the market as a reducer or adjustment profiled section.

FIG. 32: Multifunctional profiled section for floor covering according to the invention. This multifunctional finishing profiled section comprising a body which is composed of several parts (3, 6, 7*a*, 7*b*) made from a carrier material with a well-defined fibre and/or layer direction, which comprises a flange-shaped part (3), an attachment part (6) for the finishing profiled section and two nose parts (107*a*, 107*b*) extending below the flange-shaped part (3), in which the flange-shaped part (3) and the nose parts (107*a*, 107*b*) are at least partly provided with a coating layer (2).

The profiled section is in the fitted position and serves as a finish of the floor against the wall. This is a finish where the profiled section serves as a finish for 2 pieces at the same height. As a result thereof, the angle at which the attachment part is arranged a2 <90°. This is possible because fitting takes place by means of a fastening pin (90) which can rotate. It should be understood that the present invention is not limited to a multifunctional profiled section which is fastened by means of a fastening pin (90). Thus, the profiled section may also be fastened by means of a U profiled section.

Such an arrangement is known on the market as an end profiled section.

FIG. 33: Multifunctional profiled section according to the invention. The profiled section is in the fitted position and serves as a transition between 2 floors of different height. As a result thereof, the angle at which the attachment part is arranged a2<90°. This is possible because fitting takes place by means of a U profiled section (90) which can rotate. Such an arrangement is known on the market as a reducer or adjustment profiled section.

Figure 34:
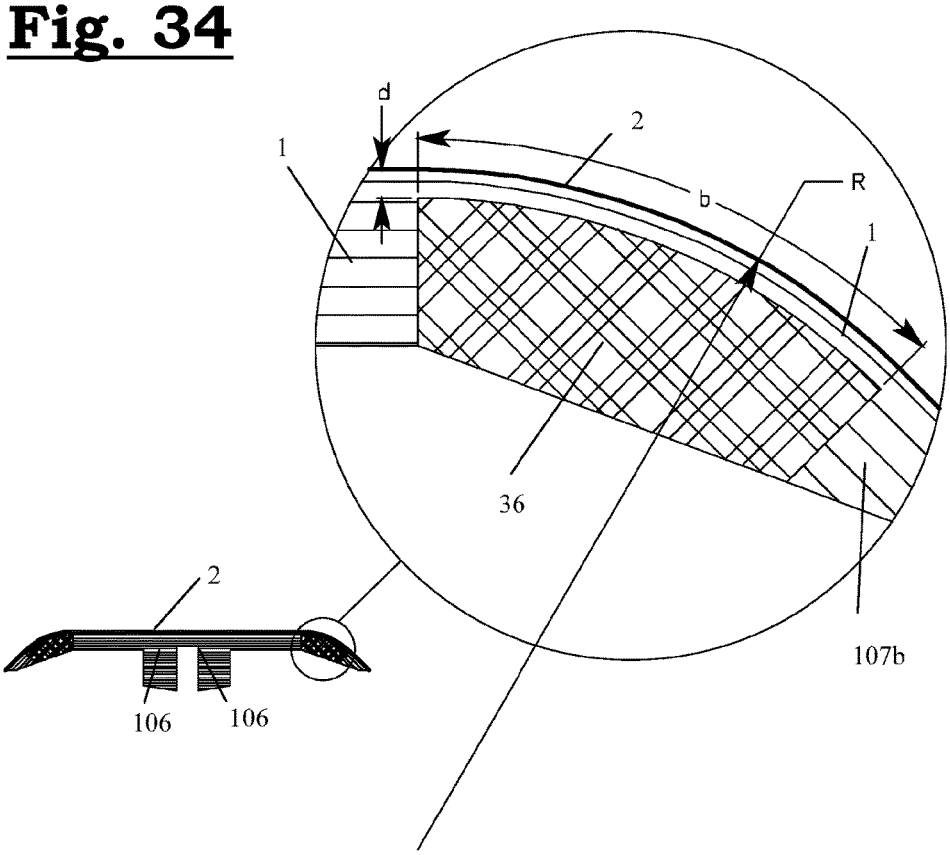

FIG. 34: Multifunctional profiled section according to the invention. This multifunctional finishing profiled section comprising a body which is composed of several parts (3, 6, 107*a*, 107*b*) made from a carrier material with a well-defined fibre and/or layer direction, which comprises a flange-shaped part (3), an attachment part (6) for the finishing profiled section and two nose parts (7*a*, 7*b*) extending below the flange-shaped part (3), in which the flange-shaped part (3) and the nose parts (107*a*, 107*b*) are at least partly provided with a coating layer (2). In the transition (11*a*, 11*b*), it can be seen that a residual layer of carrier material (1) is still present under the coating layer (2). This residual layer of carrier material (2) and the coating layer (2) in the transition (11*a*, 11*b*) are supported by a filler (36). This is very important to ensure the strength under load. The thickness d of the residual layer of carrier material (1) in the transition (11*a*, 11*b*) depends on the type of material from which the profiled section is made. With DPL, this will vary between 0.02 mm and 1.2 mm, whereas with thermoplastic carrier materials (LVT, PVC), this is more likely to be thicker. The width b of the residual layer of carrier material (1) in the transition (11*a*, 11*b*) depends on the radius R to be achieved for the rounding in the transition (11*a*, 11*b*). This radius R of the rounding in the transition (11*a* and 11*b*) will be greater with DPL than with thermoplastic materials, since, with DPL, the top layer is much more brittle as a result of which it will break sooner if too small a radius is chosen for the rounding in the transition (11*a*, 11*b*). With DPL, the width of the residual layer of carrier material (1) is between 1 mm and 8 mm, whereas this may be even smaller with thermoplastic materials.

Figure 35:
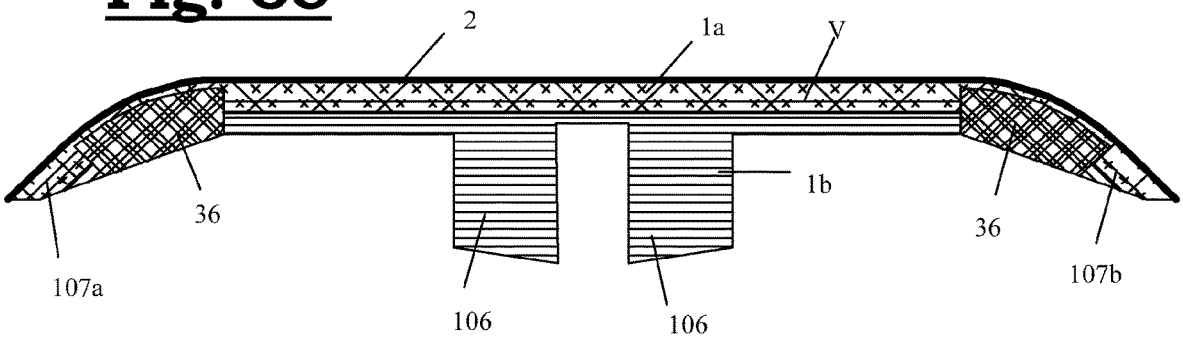

FIG. 35: Multifunctional profiled section according to the invention. This profiled section is composed of different carrier materials. The carrier material (1*a*) just under the coating layer (2) is a thermoplastic carrier material. This could be a PVC, a PP, a plastic, an LVT or a cushion vinyl. The line (V) in this thermoplastic carrier material (1*a*) indicates the presence of a layer of glass fibre in this carrier material (1*a*). This serves as a stabiliser, so that the material expands or shrinks less. The 2nd carrier material (1*b*) is a sheet material with a fibre direction. This could be an MDF or an HDF panel. Due to the profiling, only the thermoplastic layer (1*a*) comes into contact with the floor after fitting. As a result thereof, this profiled section may be regarded as being waterproof (FIG. 10).

FIG. 36: Multifunctional profiled section according to the invention. This profiled section is composed of different carrier materials. The carrier material (1*a*) just under the coating layer (2) is a thermoplastic carrier material. This could be a PVC, a PP, a plastic, an LVT or a cushion vinyl. The line (V) in this thermoplastic carrier material (1*a*) indicates the presence of a layer of glass fibre in this carrier material (1*a*). This serves as a stabiliser, so that the material expands or shrinks less. The 2nd carrier material (1*b*) is a sheet material with a fibre direction. This could be an MDF or an HDF panel. Due to the profiling on the bottom side, only the thermoplastic layer (1*a*) comes into contact with the floor after fitting. As a result thereof, this profiled section may be regarded as being waterproof. In this case, the profiled section is used as a T profiled section.

FIG. 37: Variant of a multifunctional profiled section according to the invention. Compared to the above-described profiled sections, the transitions (11*a*, 11*b*) have a minimal radius. This is achieved by milling the recess in the carrier material in a pointed shape (see FIG. 12*a*). However, this is not ideal and will in many cases lead to strong tensile stresses in the residual layer of carrier material (1) and the coating layer (2) in the transition (11*a* and 11*b*) (see FIG. 14*a*). These tensile stresses are caused by the fact that glue, milling residue or dirt (36) is present in the recesses. By wanting to fold the recess shut using a certain pressure force (Fd) to an angle of e.g. 90°, a lever is created on account of the glue, milling residue or dirt (36) in the recesses, as a result of which strong tensile forces (F1) will manifest in the coating layer (2) and in the residual layer of carrier material (1) of the transition (11*a*, 11*b*). In many cases, these tensile stresses (Ft) will cause the coating layer (2) in the transition (11*a*, 11*b*) to tear.

A solution to this problem is to face mill the transition at a certain width b, instead of a pointed shape. When folded shut, this face will shape itself in such a way that the transition becomes stress-free.

Figure 38A:
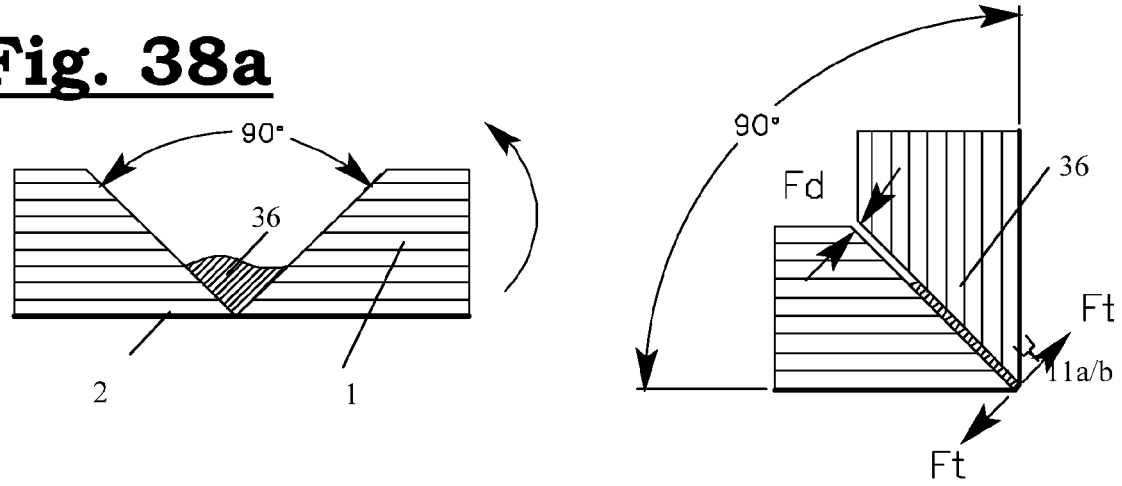

FIG. 38*a*: An example of how the layered material can be folded to manufacture a profiled section according to the invention. Compared to the above-described profiled sections, the transitions (11*a*, 11*b*) have a minimal radius. This is achieved by milling the recess in the carrier material in a pointed shape (see FIG. 12*b*). However, this is not ideal and will in many cases lead to strong tensile stresses in the residual layer of carrier material (1) and the coating layer (2) in the transition (11*a* and 11*b*). If this carrier material (1) comprises one or several layers of e.g. glass fibres (V), this tensile stress Ft will manifest as a strong shear stress Fs at the location of this glass fibre, as a result of which there is a significant risk of this carrier material tearing at the location of the glass fibre.

Figure 38B:
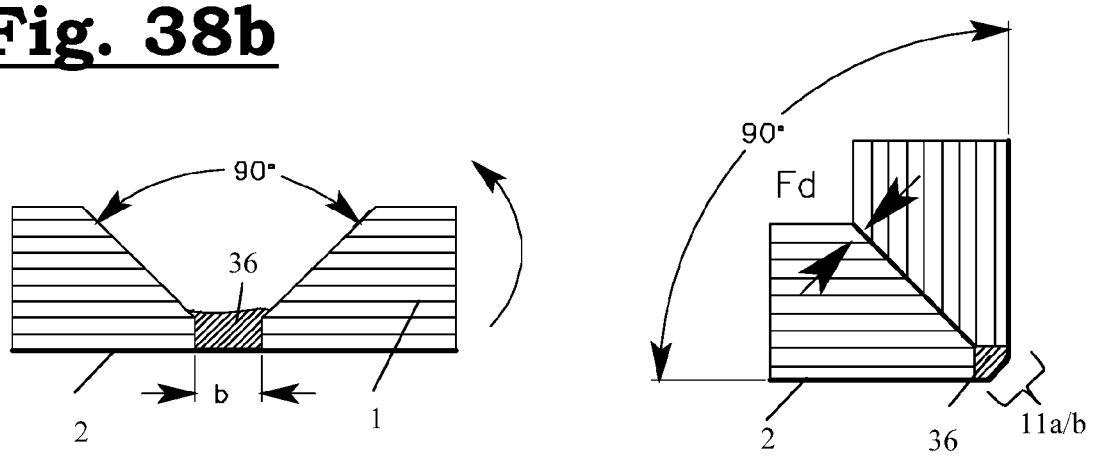

FIG. 38*b*: A solution to the above-described problem is to face mill the transition at a certain width b, instead of a pointed shape, as a result thereof, a residual part (11) is created composed of a residual layer of carrier material (1) and the decorative top layer (2). When folded shut to e.g. 90°, this face or residual part (11) will shape itself in such a way that the transition is stress-free.

Figure 38C:
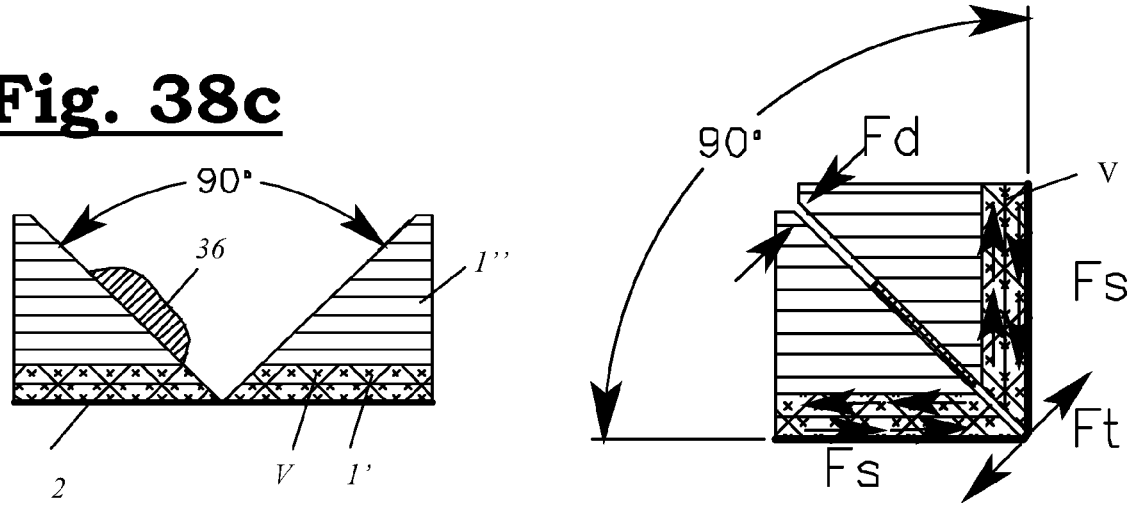

FIG. 38*c*: Sheet material which consists of different layers of carrier material (1', 1"). In this case, the carrier material 1' which is just under the coating layer (2) is a thermoplastic and has a glass fibre (V) in the core, parallel to the coating layer (2). This is a structure of an LVT floor slab. It is generally assumed that the bond between the glass fleece (V) and the thermoplastic carrier material (1') is less. Since milling is carried out to a pointed shape, large shearing forces (Fs) occur when folding the core of the LVT slab at the location of the glass fleece or glass fibre (V), as a result of which the LVT material will split at the location of the glass fleece. In order to solve this, profiling has to be carried out as described in FIG. 12*b*. Also, if the filler (36) also acts as an adhesive and the adhesive with the carrier material both above (1') and below the glass fleece (1") the stress (Fs) in the glass fleece is completely removed, as a result of which the risk of this splitting will be completely removed (see FIG. 38*b*).

Figure 39A:
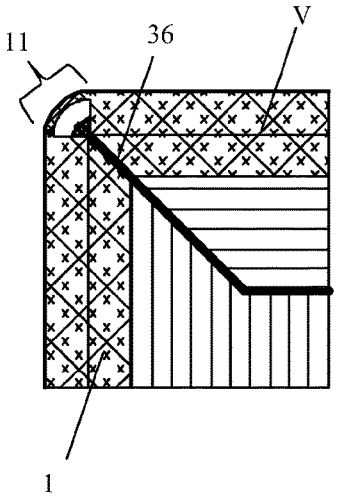

FIG. 39*a*: Detail of the transition of a skirting board according to the invention. The detail shows where the filler is present at the location of the transition (11). Under the residual layer of carrier material (1), there is an air cavity which is partly filled with a filler or adhesive (36). The residual layer of carrier material (1) is not supported by the filler (36), but the filler or adhesive (36) does ensure that the residual part and consequently the transition (11) maintain their shape.

In many cases, such as with thermoplastic carrier materials, it may be that the residual layer of carrier material (1) is still sufficiently thick, as a result of which it is not compressible.

In the centre of the layer of thermoplastic carrier material (1), there is a glass fleece (V). It can be seen in the drawing that the adhesive (36) is situated both above and below the glass fibre (V). As a result thereof, no tensile and/or shear stresses can occur in, below or above the glass fibre (V).

Figure 39B:
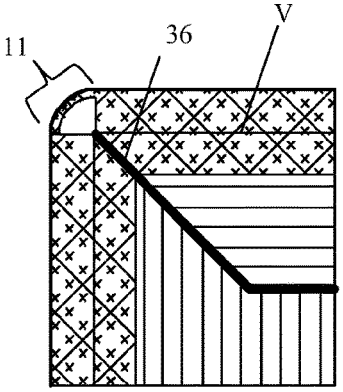

FIG. 39*b*: Detail of the transition of a skirting board according to the invention. The detail shows where the filler (36) is present at the location of the transition (11).

Under the residual layer of carrier material (1), there is an air cavity which is partly filled with a filler or adhesive (36). The residual layer of carrier material (1) is not supported by the filler (36), but the filler or adhesive (36) does ensure that the residual part and consequently the transition (11) maintain their shape.

Figure 39C:
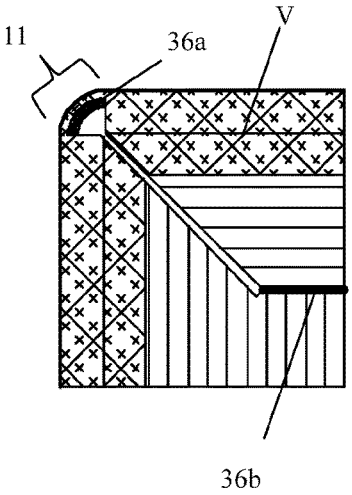

FIG. 39*c*: Detail of the transition of a skirting board according to the invention. The detail shows where the filler (36*a* and 36*b*) is present at the location of the transition (11). Under the residual layer of carrier material (1), there is an air cavity which is partly filled with a filler or adhesive (36). The residual layer of carrier material (1) is supported by the filler (36*a*). This serves to support the residual part (11). Also, there is an adhesive (36*b*) at the very end of the cavity. This serves to support the shape of the residual part (11).

Figure 39D:
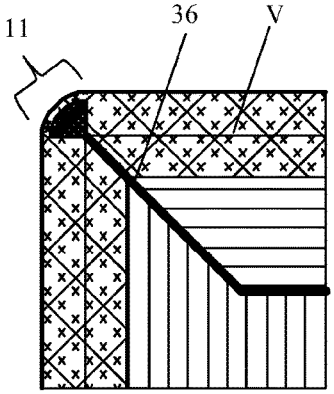

FIG. 39*d*: Detail of the transition of a skirting board according to the invention. The detail shows where the filler (36) is present at the location of the transition (11). Under the residual layer of carrier material (1), there is an air cavity which is completely filled with a filler or adhesive (36). The cavity is situated just under the residual layer of carrier material (1) and extends up to the rear side of the skirting board.

Figure 39E:
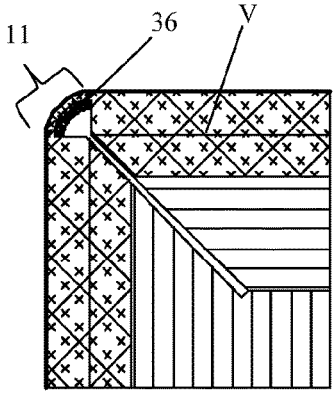

FIG. 39*e*: Detail of the transition of a skirting board according to the invention. The detail shows where the filler (36) is present at the location of the transition (11). Under the residual layer of carrier material (1), there is an air cavity which is partly filled with a filler or adhesive (36). The residual layer of carrier material (1) is supported by the filler (36). Apart from that, no adhesive (36) is present.

Figure 39F:
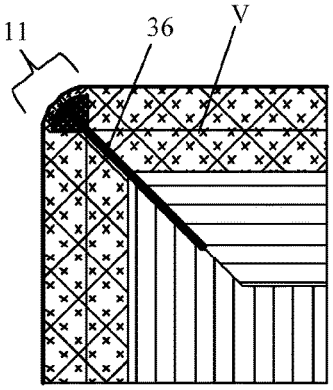

FIG. 39*f*: Detail of the transition of a skirting board according to the invention. The detail shows where the filler (36) is present at the location of the transition (11). Under the residual layer of carrier material (1), there is an air cavity which is not completely filled with a filler or adhesive (36).

The adhesive is situated just under the residual layer of carrier material (1) and extends not entirely up to the rear side of the skirting board.

The invention claimed is:

1. Skirting board for a wall of a space, comprising a body composed of at least a carrier material and a decorative top layer, in which said body comprises a first longitudinal side which forms at least a part of a front side of the skirting board and has a part of the top layer, a second longitudinal side which has at least a part of the top layer of the skirting board, and a transition (11) between the first longitudinal side and the second longitudinal side, wherein the transition has a curved configuration, wherein, at the location of said transition, the second longitudinal side, at least at the location of the transition, comprises a recess, and in that the decorative top layer (2) is continuous from the first longitudinal side to the second longitudinal side so that the top layer runs continuously along an entire visual side of the skirting board, and wherein said recess extends up to a rear side of the skirting board, and said recess has a glue chamber which is partly or fully filled with a filler having a different composition than the carrier material in areas that allow bending without breaking the decorative layer.

2. The skirting board according to claim 1, wherein the transition (11) is composed of at least a decorative top layer (2) and a residual layer of carrier material (1).

3. The skirting board according to claim 2, wherein the residual layer of carrier material (1) has an essentially constant thickness at the location of the transition.

4. The skirting board according to claim 1, wherein the recess is formed by the removal of carrier material.

5. The skirting board according to claim 1, wherein the transition (11) is supported by the filler (36).

6. The skirting board according to claim 1, wherein the transition (11) is not completely or not supported by the filler (36).

7. The skirting board according to claim 6, wherein, under the transition (11), an air cavity is situated which is not filled and which extends from the transition up to the filler (36).

8. The skirting board according to claim 1, wherein the decorative top layer (2) is composed of a decorative film/foil (7) covered with a scratch-resistant top layer (6).

9. The skirting board according to claim 1, wherein the filler (36) is an adhesive material.

10. The skirting board according to claim 1, wherein, at the location of the transition, the zone which extends above the filler and consists of a part of the top layer and a part of the carrier material, has a thickness in the range between 0.1 mm and 1 mm.

11. The skirting board according to claim 1, wherein the skirting board consists of a DPL, a DLP, a CPL, an HPL or WPC panel.

12. The skirting board according to claim 1, wherein the skirting board consists of a PP, a PVC or an LVT panel.

13. Method for producing a skirting board or finishing profiled section for floor covering, comprising a body composed of at least a carrier material and a decorative top layer, in which said body comprises a front side, being the side with the top layer, and a rear side, in which the front side comprises at least one transition (11) having a curved configuration, in which the decorative top layer (2) is continuous from the first longitudinal side to the second longitudinal side so that the top layer runs continuously along an entire visual side of the skirting board, wherein the method comprises the following steps:

supplying a panel-shaped element comprising a carrier material (1) on which a decorative top layer (2) is provided;

providing a recess (16) on the rear side of the panel-shaped element in the longitudinal direction in the carrier material (1) at the location of the transition, so that a residual part (11) is formed comprising a residual layer of carrier material (1) with an essentially constant thickness and a decorative top layer (2);

filling said recess (16) at least partly with a filler having a different composition than the carrier material;

bending the residual part (11) to the desired radius (R) or shape;

allowing the filler (36) to harden.

14. Method according to claim 13, wherein the recess is formed by removing carrier material.

15. Method according to claim 13, wherein, after the filler (36) has hardened, the entire residual layer (11) is supported or reinforced by the filler (36).

16. Method according to claim 13, wherein, after the filler (36) has hardened, residual layer (11) is not completely supported by the filler (36).

17. Method according to claim 13, wherein, after the residual part (11) has been bent to the desired radius (R), a glue chamber (L) is formed under the residual layer (11).

18. Method according to claim 17, wherein the glue chamber (L) which has been formed is only partly provided with an adhesive or filler (36).

19. Method according to claim 17, wherein the glue chamber (L) which has been formed is completely provided with adhesive or filler (36).

20. Method according to claim 13, wherein the residual part (11) is heated during folding or bending.

* * * * *